US008304153B2

(12) United States Patent
Shimada et al.

(10) Patent No.: US 8,304,153 B2
(45) Date of Patent: Nov. 6, 2012

(54) ELECTROPHOTOGRAPHIC PHOTORECEPTOR, ELECTROPHOTOGRAPHIC IMAGE FORMING METHOD, ELECTROPHOTOGRAPHIC IMAGE FORMING APPARATUS, ELECTROPHOTOGRAPHIC PROCESS CARTRIDGE

(75) Inventors: Tomoyuki Shimada, Shizuoka (JP); Ryota Arai, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 298 days.

(21) Appl. No.: 12/876,743

(22) Filed: Sep. 7, 2010

(65) Prior Publication Data

US 2011/0059392 A1 Mar. 10, 2011

(30) Foreign Application Priority Data

Sep. 10, 2009 (JP) ..... 2009-208940

(51) Int. Cl.
*G03G 5/06* (2006.01)
*G03G 5/047* (2006.01)

(52) U.S. Cl. ..... 430/78; 399/159; 430/58.5; 430/79; 430/59.1; 430/58.85; 430/58.65; 430/58.25; 430/123.4

(58) Field of Classification Search ..... 430/78, 430/79, 59.1, 58.85, 58.65, 58.25, 123.4, 430/58.5; 399/159
See application file for complete search history.

(56) References Cited

U.S. PATENT DOCUMENTS

| | | | | |
|---|---|---|---|---|
| 3,816,118 | A | 6/1974 | Byrne | |
| 3,954,568 | A | 5/1976 | DuPree | |
| 6,187,491 | B1 | 2/2001 | Ferrar et al. | |
| 2009/0087763 | A1* | 4/2009 | Weiss et al. | 430/58.5 |
| 2009/0274971 | A1* | 11/2009 | Wu | 430/58.55 |

FOREIGN PATENT DOCUMENTS

| | | | |
|---|---|---|---|
| JP | 52-36016 | | 9/1977 |
| JP | 53-95033 | | 8/1978 |
| JP | 53-132347 | | 11/1978 |
| JP | 53-133445 | | 11/1978 |
| JP | 54-2129 | | 1/1979 |
| JP | 54-12742 | | 1/1979 |
| JP | 54-14967 | | 2/1979 |
| JP | 54-17733 | | 2/1979 |
| JP | 54-21728 | | 2/1979 |
| JP | 54-22834 | | 2/1979 |
| JP | 60-196768 | | 10/1985 |
| JP | 64-17066 | | 1/1989 |
| JP | 05045901 | A * | 2/1993 |
| JP | 08202055 | A * | 8/1996 |
| JP | 08320582 | A * | 12/1996 |
| JP | 2732697 | | 12/1997 |
| JP | 11-21466 | | 1/1999 |
| JP | 2884353 | | 2/1999 |
| JP | 2001-19871 | | 1/2001 |

(Continued)

OTHER PUBLICATIONS

D.W. Jones et al. (1972), "Reaction of Phthalimidonitrene with Furans", Journal of the Chemical Society, Perkin Transactions 1, Organic and Bio-Organic Chemistry, 21, 2728.

(Continued)

*Primary Examiner* — Christopher Rodee
(74) *Attorney, Agent, or Firm* — Cooper & Dunham LLP

(57) ABSTRACT

An electrophotographic photoreceptor including a conductive substrate and a photosensitive layer overlying the conductive substrate. The photosensitive layer comprises a phthalimide isoindole derivative having a specific chemical formula.

19 Claims, 5 Drawing Sheets

FOREIGN PATENT DOCUMENTS

| | | | |
|---|---|---|---|
| JP | 2003321448 A | * | 11/2003 |
| JP | 4101676 | | 3/2008 |
| JP | 4226749 | | 12/2008 |

OTHER PUBLICATIONS

Iijima et al. (1994), Abstract of "(IB4 04) New Polymorphs of Chlorogallium Phthalocyanine and Their Photogenerating Properties", 67$^{th}$ Annual Meeting of the Chemical Society of Japan.

Daimon et al. (1994), Abstract of "(IB4 05) a New Polymorph of Flydroxy Gallium Phthalocyanine and Its application for Photoreceptor", 67$^{th}$ Annual Meeting of the Chemical Society of Japan.

Itami et al. (2000), "The Effects of Nitrogen Oxide on the Resolution of Organic Photoconductors", Konica Technical Report, vol. 13, pp. 37-40.

* cited by examiner

ELECTROPHOTOGRAPHIC PHOTORECEPTOR, ELECTROPHOTOGRAPHIC IMAGE FORMING METHOD, ELECTROPHOTOGRAPHIC IMAGE FORMING APPARATUS, ELECTROPHOTOGRAPHIC PROCESS CARTRIDGE

CROSS-REFERENCE TO RELATED APPLICATIONS

The present patent application claims priority pursuant to 35 U.S.C. §119 from Japanese Patent Application No. 2009-208940, filed on Sep. 10, 2009, which is hereby incorporated by reference herein in its entirety.

BACKGROUND

1. Field of the Invention

The present invention relates to an electrophotographic photoreceptor. In addition, the present invention also relates to an electrophotographic image forming method, an electrophotographic image forming apparatus, and an electrophotographic process cartridge using the electrophotographic photoreceptor.

2. Description of the Background

Electrophotographic image processing system devices have drastically improved recently. In particular, laser printers and digital copiers, which convert information into digital signals and record it optically, have drastically improved their printing quality and reliability. These laser printers and digital copiers have been merged with high-speed printing technologies and applied to full-color printing technologies. In view of this situation, it is desirable that electrophotographic photoreceptors (hereinafter simply "photoreceptors") are both capable of producing high-quality images and highly durable.

Electrophotographic laser printers and digital copiers generally employ organic photoreceptors comprised of organic photosensitive materials because of their low cost, high productivity, and nonpolluting property. The organic photoreceptors are broadly classified into single-layer photoreceptors and functionally-separated multilayer photoreceptors. The first practical organic photoreceptor is a PVK-TNF charge-transfer-complex-type photoreceptor, which is one type of single-layer photoreceptors.

In 1968, Hayashi and Regensburger independently invented a PVK/a-Se multilayer photoreceptor. In 1977 and 1978, Meltz and Schlosser, respectively, invented a multilayer photoreceptor in which the photosensitive layer is comprised of organic materials only. More specifically, the photosensitive layer is comprised of an organic pigment dispersing layer and an organic low-molecular-weight polymer dispersing layer. The former is what is called a charge generation layer (CGL) that absorbs light to generate charge. The latter is what is called a charge transport layer (CTL) that injects and transports the charge generated in the CGL to neutralize surface charge. Such a multilayer photoreceptor is called a functionally-separated multilayer photoreceptor.

Disadvantageously, such an organic photosensitive layer is more likely to be abraded with repeated use compared to an inorganic photosensitive layer. Abrasion of the photosensitive layer may degrade the charged potential and photosensitivity of the photoreceptor, and may accelerate deterioration of the resultant image density and quality. Therefore, various attempts have been made to improve abrasion resistance of organic photoreceptors.

On the other hand, in accordance with recent efforts to make electrophotographic apparatuses faster and smaller, the photoreceptors have also been downsized, i.e., the diameter of the photoreceptors has been reduced. For this reason, an improvement of durability of the organic photoreceptors has become even more important.

As described above, various attempts have been made to improve abrasion resistance of the organic photoreceptors. For example, one proposed approach involves lubricating or hardening the photosensitive layer. Another proposed approach involves including a filler in the photosensitive layer. Yet another proposed approach involves forming a CTL with a charge transport polymer instead of dispersing a low-molecular-weight charge transport material in a polymer. However, even when the above approaches prevent abrasion of the photosensitive layer, other problems occur. For example, oxidizing substances such as ozone and NOx, which are produced with repeated use of the photoreceptor depending on surrounding environmental conditions, may adsorb to the surface of the photosensitive layer and reduce electric resistance thereof, resulting in production of blurred images. Conventional photoreceptors have avoided such a problem because oxidizing substances adhered to the photosensitive layer can be removed along with abrasion of the photosensitive layer.

By contrast, more recent, highly durable photoreceptors cannot avoid the problem in the same way as the conventional photoreceptors do, because recent photosensitive layers have been improved to have higher abrasion resistance, as described above. In view of this situation, one proposed approach for further improving durability includes providing a heater to the photoreceptor so that the oxidizing substances are vaporized. However, this approach is against the recent trends toward downsizing apparatuses and reducing electric power consumption. Another proposed approach includes adding an antioxidant in the photosensitive layer. However, since typical antioxidants have no photoconductivity, this approach may cause deterioration of sensitivity and increase of residual potential of the photoreceptor when the amount of antioxidant in the photosensitive layer is too large.

In short, highly-abrasion-resistant photoreceptors produce side effects such as production of blurred images and deterioration of image resolution. Thus, it may be difficult for photoreceptors to produce high-quality images while having high durability. In order to prevent production of blurred images, electric resistance is preferably as large as possible. By contrast, in order to prevent increase of residual potential, electric resistance is preferably as small as possible. Such a tradeoff makes it more difficult to provide a highly durable photoreceptor which produces high-quality images.

Most commercially available photoreceptors are functionally-separated multilayer photoreceptors comprising a conductive substrate, a charge generation layer, and a charge transport layer. The charge transport layer includes a charge transport material, such as a hole transport material generally used for negatively chargeable electrophotographic photoreceptors.

Corona discharge is well known as a reliable charging method for charging electrophotographic photoreceptors. Therefore, most copiers and printers employ corona discharge. However, corona discharge is less reliable when charging a photoreceptor negatively that when charging the photoreceptor positively. To compensate for poor reliability of the negative corona discharge, a scorotron charging method is preferably employed in a process using a negatively chargeable electrophotographic photoreceptor, but it results in a cost increase. Additionally, the negative corona discharge produces more ozone, which causes various types of chemical damage. Therefore, a long-term negative corona discharge may cause oxidization and deterioration of binder resins and charge transport materials, and accumulation of ionic compounds (e.g., nitrogen oxide ion, sulfur oxide ion, ammonium ion) on the surface of the photoreceptor, which results in deterioration of the resultant image quality. Further, in order to prevent ozone emission, an ozone filter is generally provided in copiers and printers employing a negative charging method, which also increases cost. Ozone emission also causes environmental damage.

To overcome the above-described problems in charging negatively chargeable photoreceptors, positively chargeable photoreceptors are being developed. The positively chargeable photoreceptors advantageously produce less ozone and fewer ionic compounds (e.g., nitrogen oxide ion) than negatively chargeable photoreceptors. Additionally, widely used two-component developers can produce more reliable images without environmental variation when used in combination with positively chargeable photoreceptors.

However, single-layer or reverse-layer positively chargeable photoreceptors have a disadvantage in that charge generation materials, which are very susceptible to oxidizing substances such as ozone and nitrogen oxide ions, are present at the surface of the photoreceptor. Such photoreceptors are highly affected by environmental gases, such as emissions from heaters and cars.

From the viewpoint of high-speed printing, negatively chargeable photoreceptors have an advantage over positively chargeable photoreceptors. This is because most currently available organic materials having high charge transportability are limited to hole transport materials. When a normal multilayer photoreceptor having a charge transport layer on its outermost surface includes a hole transport material in the charge transport layer, in principle, the photoreceptor can be charged to negative polarity only.

Accordingly, a photoreceptor which is chargeable to both positive and negative polarities may be more practical and advantageous in terms of cost reduction and high-speed printing.

In view of this situation, Japanese Patent No. 2732697 (JP-2732697-B) discloses an electrophotographic photoreceptor chargeable to both positive and negative polarities. The photoreceptor includes a diphenoquinone derivative as a charge transport material, but the diphenoquinone derivative has a relatively low charge transportability. Therefore, the photoreceptor may produce blurred images with repeated use, especially when the printing speed is high or the diameter of the photoreceptor is small in accordance with downsizing of the apparatus.

Japanese Patent Application Publication No. 2000-231204 (JP-2000-231204-A) discloses an aromatic compound having a dialkylamino group as an acid scavenger for use in a photoreceptor. It is disclosed therein that such an aromatic compound prevents production of blurred images caused by oxidizing gases, even after the photoreceptor is repeatedly used. However, charge transport ability of the aromatic compound is too low to meet the demands of highly sensitive, high-speed photoreceptors.

JP-S60-196768-A and JP-2884353-B each disclose stilbene compounds having a dialkylamino group. A technical document titled "The Effects of Nitrogen Oxide on the Resolution of Organic Photoconductors" (Itami et al., Konica Technical Report, Vol. 13 (2000), p. 37-40) reports that the above stilbene compounds prevent production of blurred images caused by oxidizing gases.

The stilbene compounds have a triarylamine structure, which serves as a charge transporting site. The triarylamine structure has a dialkylamino group, which is a substituent having a strong mesomeric effect (i.e., +M effect) on a resonance position. Therefore, the ionized potential of the stilbene compound is extremely small. In a case where such a stilbene compound is used alone as a charge transport material in a photosensitive layer, the charge retention capability of the photosensitive layer may be extremely poor from the initial stage, or may degrade with time. For this reason, it is difficult to put the stilbene compounds into practical use. Even when the stilbene compound is used in combination with another charge transport material, the stilbene compound may disadvantageously serve as a hole trapping site, because the ionized potential of the stilbene compound is considerably smaller than that of the other charge transport material. As a result, the resultant photoreceptor may have extremely low sensitivity and high residual potential.

JP-2004-258253-A discloses a photoreceptor including a stilbene compound and a diamine compound. It is disclosed therein that such a photoreceptor has an improved resistance to oxidizing gases without degrading sensitivity. However, the photoreceptor cannot meet recent demands for high-speed printing or downsizing of photoreceptor.

A technical document titled "Reaction of Phthalimidonitrene with Furans" (D. W. Jones et al., Journal of the Chemical Society, Perkin Transactions 1, Organic and Bio-Organic Chemistry, 21, 2728 (1972)) discloses a synthesis process of 1,3-diophenyl-2-phthalimide isoindole, which is one example of phthalimide isoindole derivatives. However, there is no disclosure that the phthalimide isoindole derivative is usable in a photoreceptor.

SUMMARY

Exemplary aspects of the present invention are put forward in view of the above-described circumstances, and provide a novel electrophotographic photoreceptor, a novel electrophotographic image forming method, a novel electrophotographic image forming apparatus, and a novel electrophotographic process cartridge, each of which produces high-quality images for an extended period of time while having high durability.

In one exemplary embodiment, a novel electrophotographic photoreceptor includes a conductive substrate and a photosensitive layer overlying the conductive substrate. The photosensitive layer comprises a phthalimide isoindole derivative having the following formula (1):

(1)

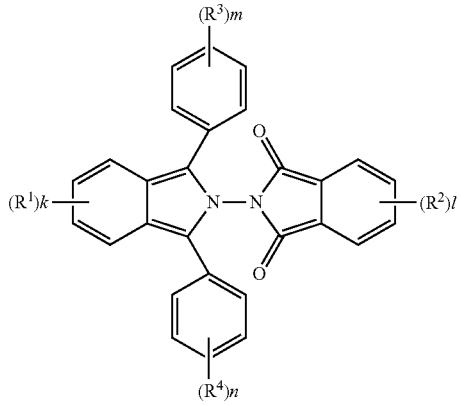

wherein each of $R^1$, $R^2$, $R^3$, and $R^4$ independently represents a hydrogen atom, a substituted or unsubstituted alkyl group, a substituted or unsubstituted aromatic hydrocarbon group, a halogen atom, or a nitro group; each of k and l independently represents an integer of from 1 to 4; and each of m and n independently represents an integer of from 1 to 5.

In another exemplary embodiment, a novel electrophotographic image forming method includes charging the above electrophotographic photoreceptor; irradiating the charged photoreceptor with light containing image information to form an electrostatic latent image thereon; developing the electrostatic latent image with a toner to form a toner image; and transferring the toner image from the photoreceptor onto a transfer material.

In yet another exemplary embodiment, a novel electrophotographic image forming apparatus includes the above electrophotographic photoreceptor that bears an electrostatic latent image; a charger that charges the photoreceptor; an irradiator that irradiates the charged photoreceptor with light containing image information to form an electrostatic latent image thereon; a developing device that develops the electrostatic latent image with a toner to form a toner image; and a transfer device that transfers the toner image from the photoreceptor onto a transfer material.

In further embodiment, a novel electrophotographic process cartridge detachably mountable on image forming apparatus includes the above electrophotographic photoreceptor that bears an electrostatic latent image; and at least one of a charger that charges the photoreceptor, a developing device that develops the electrostatic latent image into a toner image, and a cleaning device that removes residual toner particles remaining on the photoreceptor after transferring a toner image therefrom.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
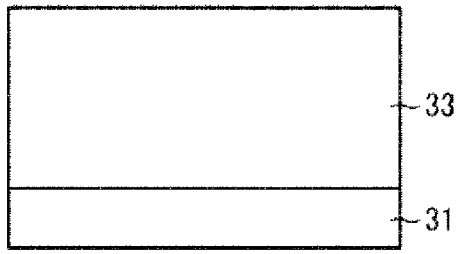
FIGS. 1 to 6 are schematic cross-sectional views illustrating exemplary embodiments of the electrophotographic photoreceptors according to this specification.

Exemplary aspects of the present invention provide an electrophotographic photoreceptor comprising a photosensitive layer including a phthalimide isoindole derivative having the following formula (1):

(1)

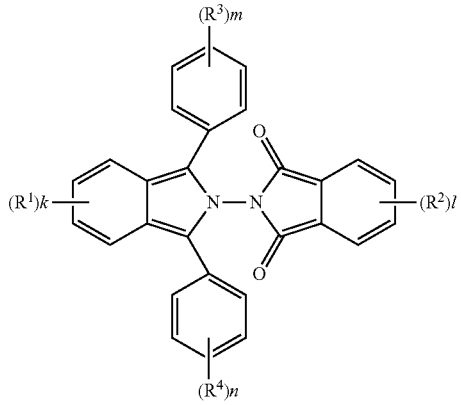

wherein each of $R^1$, $R^2$, $R^3$, and $R^4$ independently represents a hydrogen atom, a substituted or unsubstituted alkyl group, a substituted or unsubstituted aromatic hydrocarbon group, a halogen atom, or a nitro group; each of k and l independently represents an integer of from 1 to 4; and each of m and n independently represents an integer of from 1 to 5.

The above photoreceptor solves the problem of production of blurred images caused by oxidizing gases. The above photoreceptor is chargeable to both positive and negative polarities.

The reason why the photoreceptor can solve the problem of blurred images is considered that the amino group, which is a strong basic group, in the phthalimide isoindole derivative electrically neutralizes the oxidizing gases. The phthalimide isoindole derivative can more improve its sensitivity and stability when used in combination with another charge transport material.

The phthalimide isoindole derivative is chargeable to both positive and negative polarities. Therefore, the resulting photoreceptor is also chargeable to both positive and negative polarities regardless of its layer structure and chemical composition.

The phthalimide isoindole derivative having the formula (1) can be prepared by a following method.

For example, as shown in the following schemes, in the first process, a 4,7-dihydro-1,3-diphenylbenzo[c]furan derivative is reacted with an N-aminophthalimide derivative to produce a hydrazone derivative. In the second process, the hydrazone derivative is subjected to ring-closing to produce a phthalimide isoindole derivative having the formula (1).

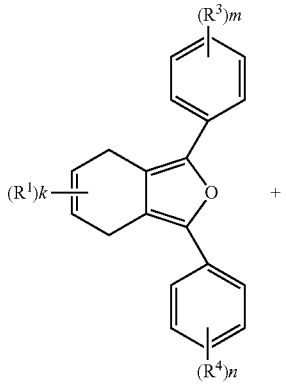

-continued

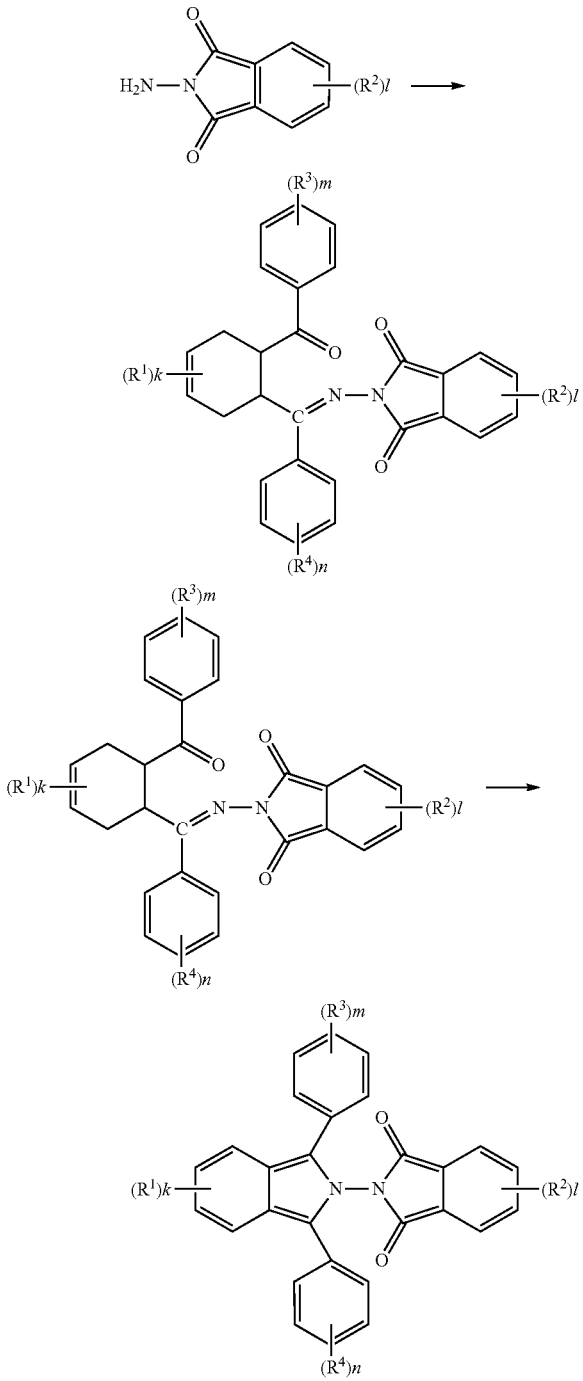

In the first process, the following solvents can be used, but usable solvents are not limited thereto; benzene, toluene, xylene, chloronaphthalene, acetic acid, pyridine, methylpyridine, N,N-dimethylformamide, N,N-dimethylacetamide, carbon tetrachloride, chloroform, and dichloromethane.

The reaction temperature is preferably between 0° C. and room temperature in the first process, and between room temperature and 100° C. in the second process.

The alkyl group represented by $R^1$, $R^2$, $R^3$, or $R^4$ in the formula (1) may be, for example, methyl group, ethyl group, propyl group, butyl group, hexyl group, or undecanyl group.

The aromatic hydrocarbon group represented by $R^1$, $R^2$, $R^3$, or $R^4$ in the formula (1) may be, for example, a group of aromatic rings such as benzene, biphenyl, naphthalene, anthracene, fluorene, or pyrene; or a group of aromatic heterocyclic rings such as pyridine, quinoline, thiophene, furan, oxazole, oxadiazole, or carbazole.

The halogen atom represented by $R^1$, $R^2$, $R^3$, or $R^4$ in the formula (1) may be, for example, a fluorine atom, a chlorine atom, a bromine atom, or an iodine atom.

The above alkyl and aromatic hydrocarbon groups may be substituted with the following substituents, but suitable substituents are not limited thereto: an alkyl group (e.g., methyl group, ethyl group, propyl group, butyl group, hexyl group, undecanyl group), an alkoxy group (e.g., methoxy group, ethoxy group, propoxy group, butoxy group), a halogen atom (e.g., a fluorine atom, a chlorine atom, a bromine atom, an iodine atom), a dialkylamino group, a diphenylamino group, a nitro group, an aromatic hydrocarbon group (e.g., a group of aromatic rings such as benzene, biphenyl, naphthalene, anthracene, fluorene, or pyrene; a group of aromatic heterocyclic rings such as pyridine, quinoline, thiophene, furan, oxazole, oxadiazole, or carbazole).

The compounds No. 1 to 33 listed below are specific preferred examples of the phthalimide isoindole derivative having the formula (1).

1

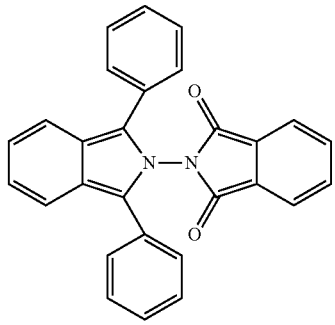

2

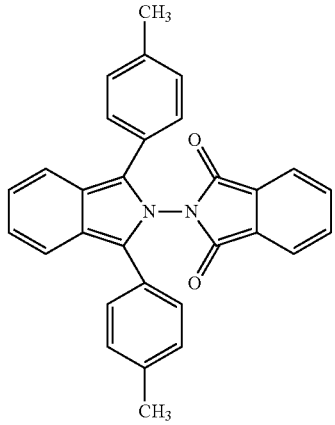

-continued
3
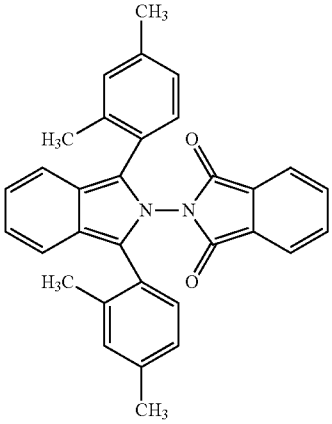
4
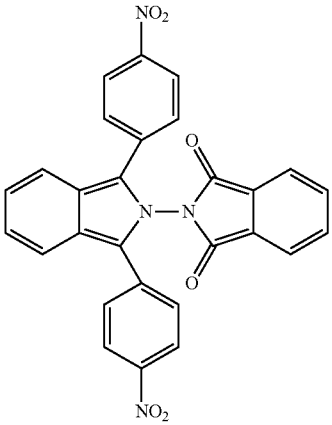
5
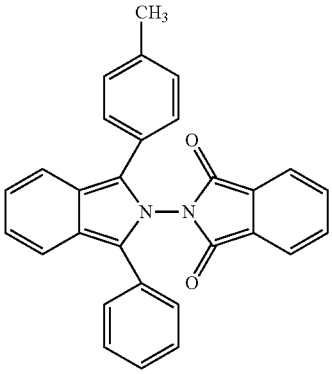
6
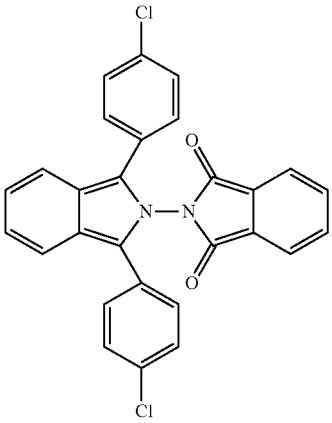
-continued
7
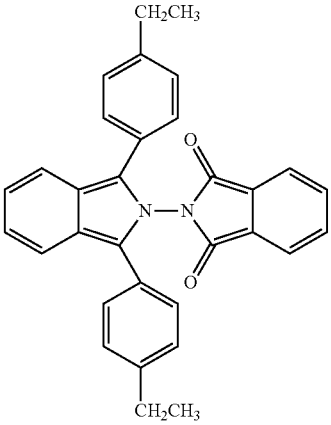
8
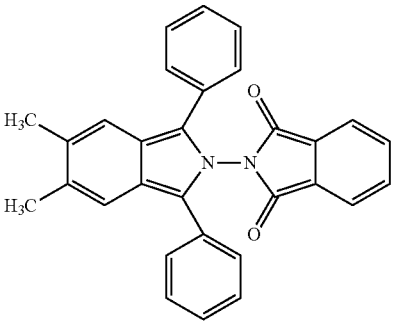
9
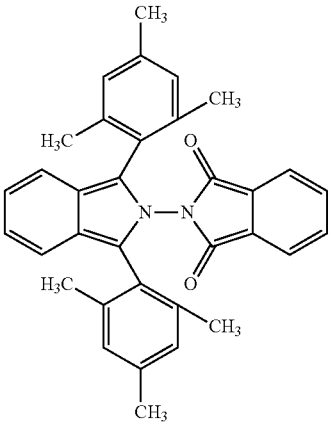

-continued
10
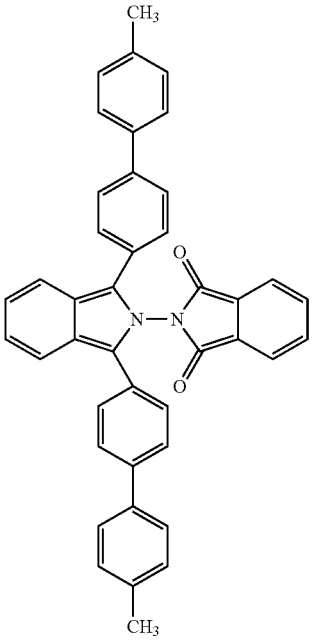
11
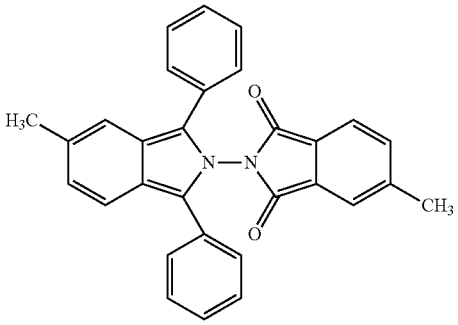
12
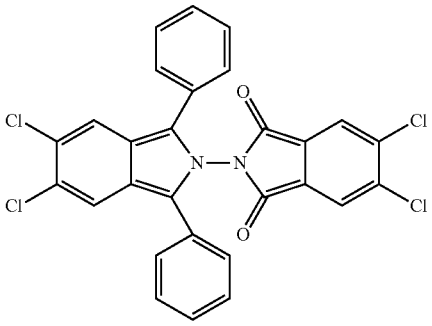
13
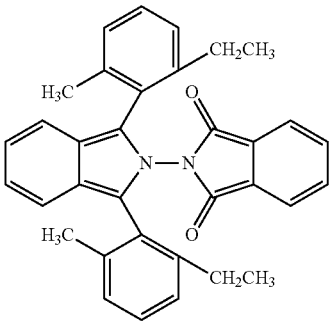
-continued
14
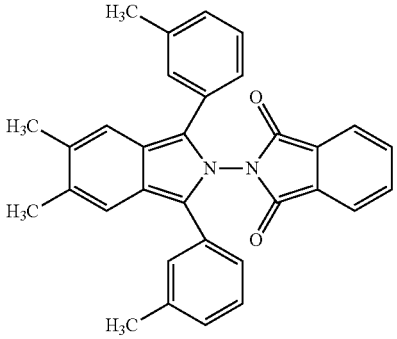
15
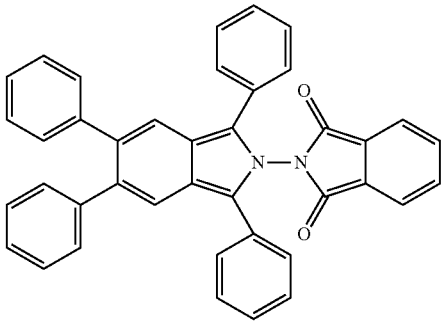
16
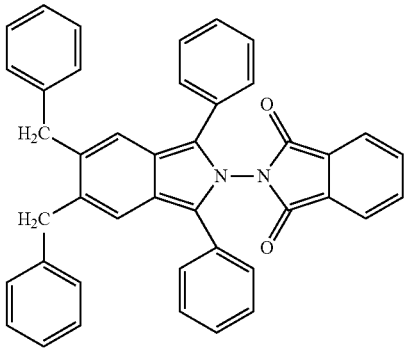
17
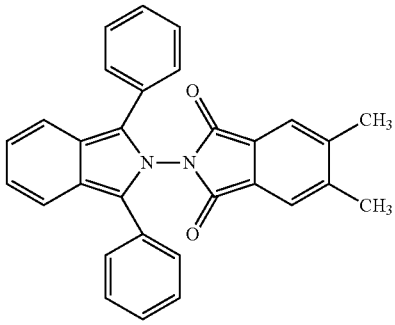

-continued
18
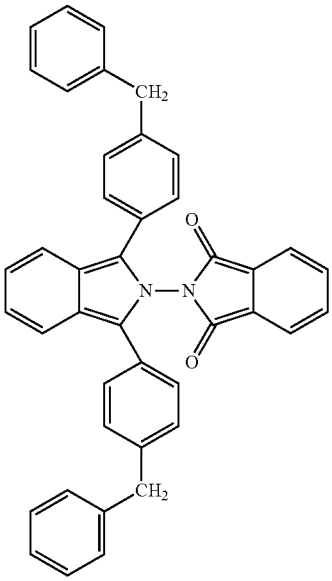
19
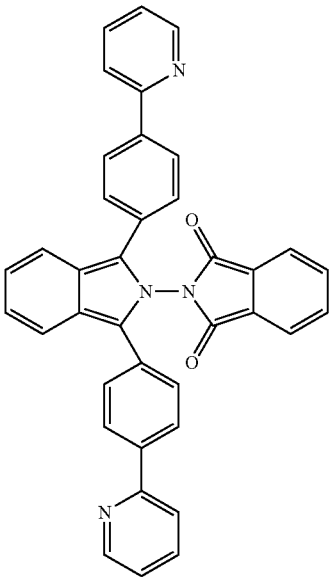
20
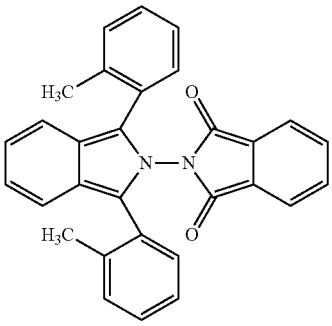
-continued
21
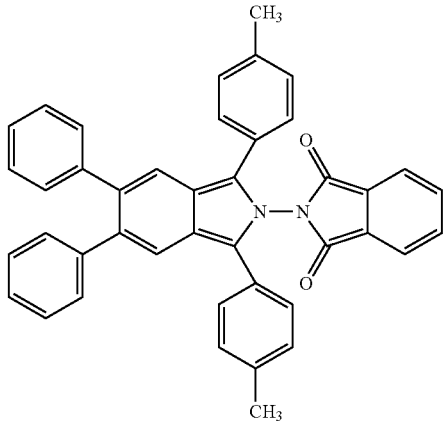
22
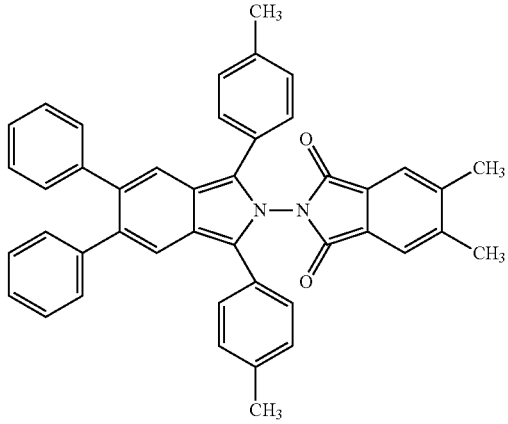
23
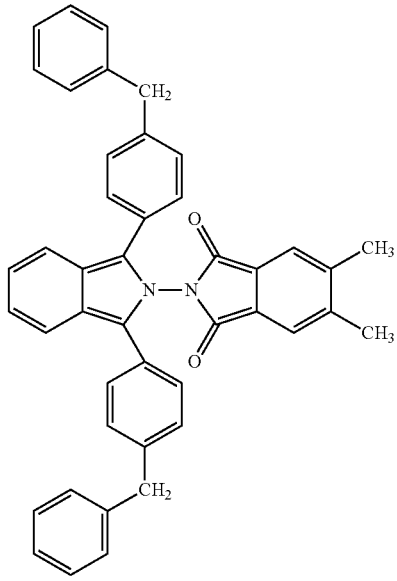

-continued
24
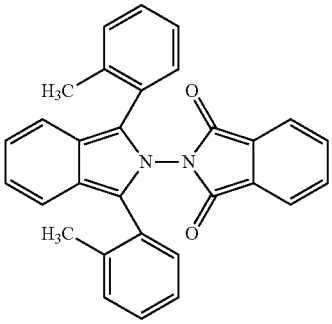
25
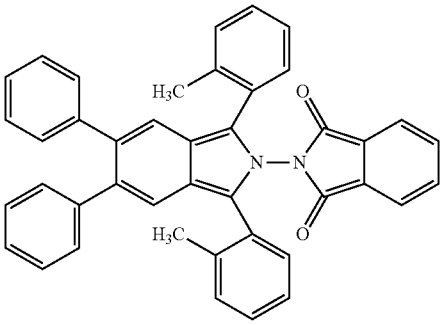
26
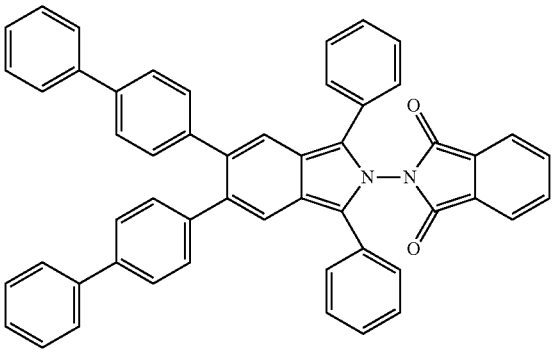
27
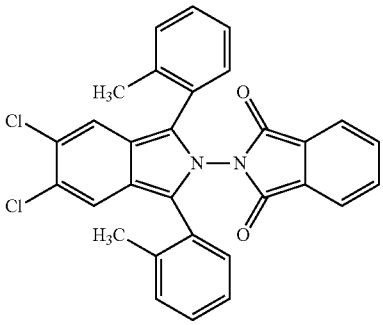
-continued
28
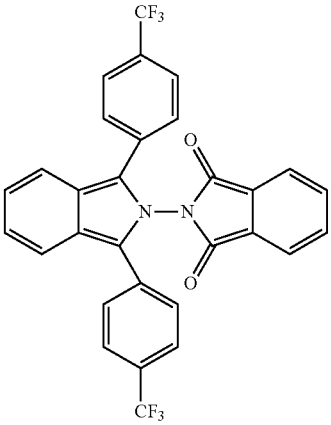
29
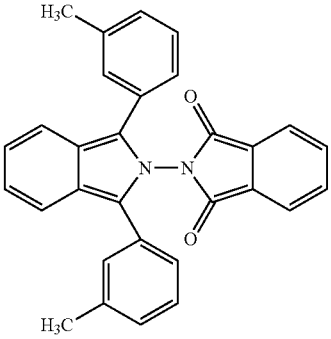
30
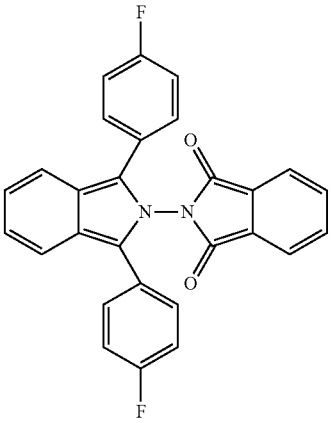
31
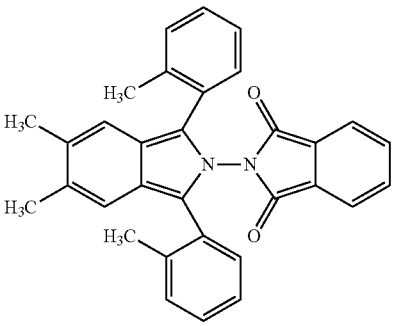

-continued

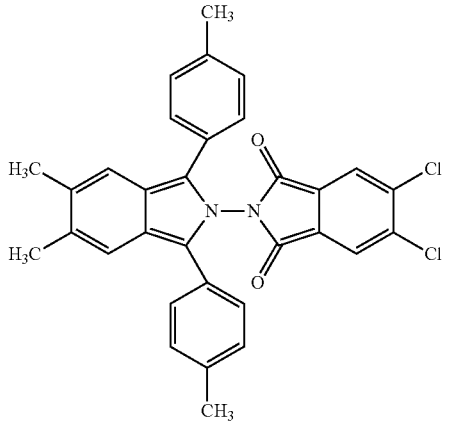

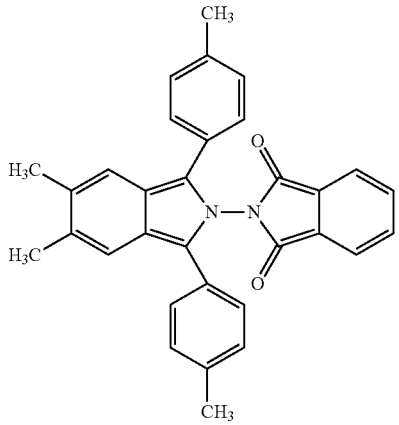

Next, exemplary layer structures of the electrophotographic photoreceptors according to this specification are described with reference to FIGS. 1 to 6. FIGS. 1 to 6 are schematic cross-sectional views illustrating exemplary embodiments of the electrophotographic photoreceptor according to this specification.

Within the context of the present specification, if a first layer is stated to be "overlaid" on, or "overlying" a second layer, the first layer may be in direct contact with a portion or all of the second layer, or there may be one or more intervening layers between the first and second layer, with the second layer being closer to the substrate than the first layer.

Referring to FIG. 1, a photosensitive layer 33 comprising a charge generation material and a charge transport material is located overlying a conductive substrate 31.

Figure 2:
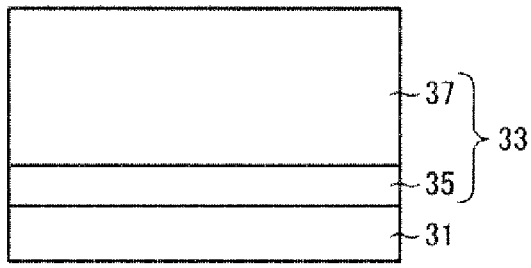

Referring to FIG. 2, a charge generation layer 35 comprising a charge generation material is located overlying a conductive substrate 31, and a charge transport layer 37 comprising a charge transport material is located overlying the charge generation layer 35.

Figure 3:
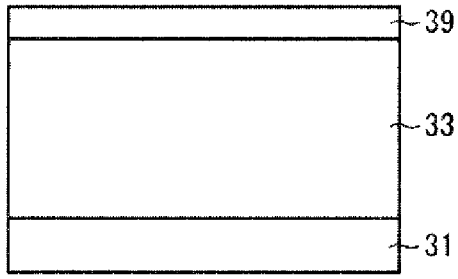

Referring to FIG. 3, a photosensitive layer 33 comprising a charge generation material and a charge transport material is located overlying a conductive substrate 31, and a protective layer 39 is located overlying the photosensitive layer 33. The protective layer 39 may include the above-described phthalimide isoindole derivative having the formula (1).

Figure 4:
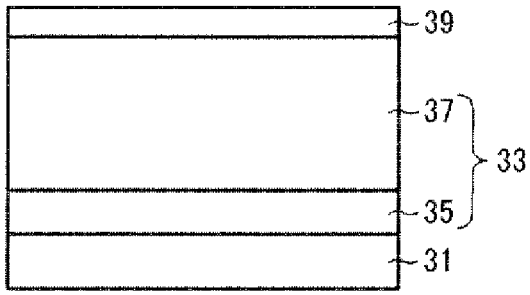

Referring to FIG. 4, a charge generation layer 35 comprising a charge generation material is located overlying a conductive substrate 31, a charge transport layer 37 comprising a charge transport material is located overlying the charge generation layer 35, and a protective layer 39 is located overlying the charge transport layer 37. The protective layer 39 may include the above-described phthalimide isoindole derivative having the formula (1).

Figure 5:
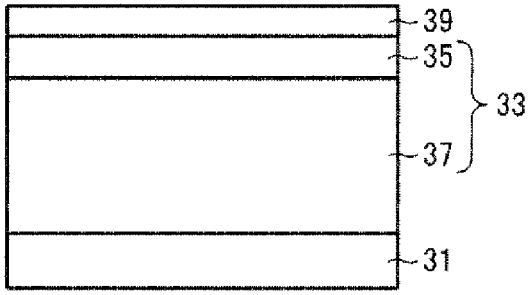

Referring to FIG. 5, a charge transport layer 37 comprising a charge transport material is located overlying a conductive substrate 31, and a charge generation layer 35 comprising a charge generation material is located overlying the charge transport layer 37.

Figure 6:
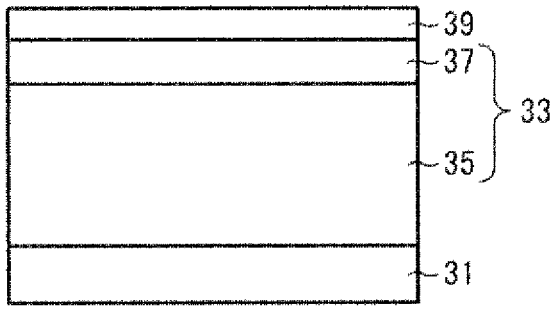

Referring to FIG. 6, a charge transport layer 37 comprising a charge transport material is located overlying a conductive substrate 31, a charge generation layer 35 comprising a charge generation material is located overlying the charge transport layer 37, and a protective layer 39 is located overlying the charge generation layer 35. The protective layer 39 may include the above-described phthalimide isoindole derivative having the formula (1).

Suitable materials for the conductive substrate 31 include conductive materials having a volume resistivity of $10^{10}$ Ω·cm or less. Specific examples of such materials include, but are not limited to, plastic films, plastic cylinders, or paper sheets, on the surface of which a metal such as aluminum, nickel, chromium, nichrome, copper, gold, silver, platinum, and the like, or a metal oxide such as tin oxide, indium oxide, and the like, is formed by deposition or sputtering. In addition, a metal cylinder can also be used as the conductive substrate 31, which is prepared by tubing a metal such as aluminum, aluminum alloys, nickel, and stainless steel by a method such as a drawing ironing method, an impact ironing method, an extruded ironing method, and an extruded drawing method, and then treating the surface of the tube by cutting, super finishing, polishing, and the like treatments. In addition, an endless nickel belt and an endless stainless steel belt disclosed in Examined Japanese Application Publication No. 52-36016, the disclosure thereof being incorporated herein by reference, can be also used as the conductive substrate 31.

Further, substrates, in which a conductive layer is formed on the above-described conductive substrates by applying a coating liquid including a binder resin and a conductive powder thereto, can be used as the conductive substrate 31. Specific examples of usable conductive powders include, but are not limited to, carbon black, acetylene black, powders of metals such as aluminum, nickel, iron, nichrome, copper, zinc, and silver, and powders of metal oxides such as conductive tin oxides and ITO. Specific examples of usable binder resins include thermoplastic, thermosetting, and photocrosslinking resins, such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethylcellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin. Such a conductive layer can be formed by coating a coating liquid in which a conductive powder and a binder resin are dispersed or dissolved in a proper solvent such as tetrahydrofuran, dichloromethane, methyl ethyl ketone, and toluene, and then drying the coated liquid.

In addition, substrates, in which a conductive layer is formed on a surface of a cylindrical substrate using a heat-shrinkable tube comprised of a resin such as polyvinyl chloride, polypropylene, polyester, polystyrene, polyvinylidene chloride, polyethylene, chlorinated rubber, and TEFLON®, which disperses a conductive powder therein, can also be used as the conductive substrate 31.

Exemplary embodiments of the photosensitive layer 33 are described below. The photosensitive layer 33 may be either a single layer or a multilayer comprising the charge generation layer 35 and the charge transport layer 37.

The charge generation layer 35 includes a charge generation material as a main component. Specific examples of usable charge generation materials include, but are not limited to, azo pigments such as C. I. Pigment Blue 25 (Color Index 21180), C. I. Pigment Red 41 (Color Index 21200), C. I. Acid Red 52 (Color Index 45100), C. I. Basic Red 3 (Color Index 45210), azo pigments having a carbazole skeleton (described in JP-S53-95033-A, the disclosures thereof being incorporated herein by reference), azo pigments having a distyrylbenzene skeleton (described in JP-S53-133445-A, the disclosures thereof being incorporated herein by reference), azo pigments having a triphenylamine skeleton (described in JP-S53-132347-A, the disclosures thereof being incorporated herein by reference), azo pigments having a dibenzothiophene skeleton (described in JP-554-21728-A, the disclosures thereof being incorporated herein by reference), azo pigments having an oxadiazole skeleton (described in JP-S54-12742-A, the disclosures thereof being incorporated herein by reference), azo pigments having a fluorenone skeleton (described in JP-S54-22834-A, the disclosures thereof being incorporated herein by reference), azo pigments having a bisstilbene skeleton (described in JP-S54-17733-A, the disclosures thereof being incorporated herein by reference), azo pigments having a distyryloxadiazole skeleton (described in JP-S54-2129-A, the disclosures thereof being incorporated herein by reference), azo pigments having a distyrylcarbazole skeleton (described in JP-S54-14967-A, the disclosures thereof being incorporated herein by reference), and azo pigments having a benzanthrone skeleton; phthalocyanine pigments such as C. I. Pigment Blue 16 (Color Index 74100), Y-type oxo-titanium phthalocyanine (described in JP-S64-17066-A, the disclosures thereof being incorporated herein by reference), A(β)-type oxo-titanium phthalocyanine, B(α)-type oxo-titanium phthalocyanine, 1-type oxo-titanium phthalocyanine (described in JP-S11-21466-A, the disclosures thereof being incorporated herein by reference), II-type chlorogallium phthalocyanine (described in the abstract of "(1B4 04) New Polymorphs of Chlorogallium Phthalocyanine and Their Photogenerating Properties" presented by Iijima et al. in the $67^{th}$ annual meeting of the Chemical Society of Japan in 1994, the disclosures thereof being incorporated herein by reference), V-type hydroxygallium phthalocyanine (described in the abstract of "(1B4 05) A New Polymorph of Hydroxy Gallium phthalocyanine and Its application for Photoreceptor" presented by Daimon et al. in the $67^{th}$ annual meeting of the Chemical Society of Japan in 1994, the disclosures thereof being incorporated herein by reference), and X-type metal-free phthalocyanine (described in U.S. Pat. No. 3,816,118); indigo pigments such as C. I. Vat Brown 5 (Color Index 73410) and C. I. Vat Dye (Color Index 73030); and perylene pigments such as ALGOL SCARLET B and INDANTHRENE SCARLET R (both from Bayer AG). These materials can be used alone or in combination.

The charge generation layer 35 may be formed by applying a charge generation layer coating liquid on a conductive substrate, followed by drying. The charge generation layer coating liquid may be prepared by dispersing a charge generation material, optionally along with a binder resin, in a solvent using a ball mill, an attritor, a sand mill, or an ultrasonic disperser.

Specific examples of binder resins optionally included in the charge generation layer 35 include, but are not limited to, polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyvinyl pyridine, cellulose resins, casein, polyvinyl alcohol, and polyvinyl pyrrolidone. The content of the binder resin in the charge generation layer 35 is preferably from 0 to 500 parts by weight, and more preferably from 10 to 300 parts by weight, per 100 parts by weight of the charge generation material included in the charge generation layer 35. The binder resin may be added to the coating liquid either before or after the charge generation material is dispersed therein.

Specific examples of usable solvents for the charge generation layer coating liquid include, but are not limited to, isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, and ligroin. Among these solvents, ketone solvents, ester solvents, and ether solvents are preferable. These solvents can be used alone or in combination.

The charge generation layer coating liquid includes the charge generation material, the solvent, and the binder resin as main components, and may optionally include additives such as an intensifier, a dispersing agent, a surfactant, and a silicone oil.

Suitable coating methods for forming the charge generation layer 35 include, but are not limited to, a dip coating method, a spray coating method, a bead coating method, a nozzle coating method, a spinner coating method, and a ring coating method. The charge generation layer 35 preferably has a thickness of from 0.01 to 5 μm, and more preferably from 0.1 to 2 μm.

The charge transport layer 37 includes a charge transport material as a main component. The charge transport material may be the phthalimide isoindole derivative having the formula (1) alone, or a mixture of the phthalimide isoindole derivative having the formula (1) with another charge transport material. Charge transport materials are generally classified into hole transport materials, electron transport materials, and charge transport polymers.

Specific preferred examples of suitable hole transport materials include, but are not limited to, poly-N-carbazole and derivatives thereof, poly-γ-carbazolylethyl glutamate and derivatives thereof, pyrene-formaldehyde condensates and derivatives thereof, polyvinyl pyrene, polyvinyl phenanthrene, oxazole derivatives, imidazole derivatives, triphenylamine derivatives, and the compounds having the following formulae (21) to (44).

(21)

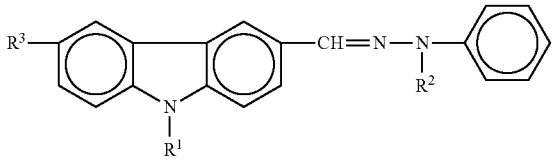

wherein $R^1$ represents a methyl group, an ethyl group, a 2-hydroxyethyl group, or a 2-chloroethyl group; $R^2$ represents a methyl group, an ethyl group, a benzyl group, or a phenyl group; $R^3$ represents a hydrogen atom, a chlorine atom, a bromine atom, an alkyl group having 1 to 4 carbon atoms, an alkoxy group having 1 to 4 carbon atoms, a dialkylamino group, or a nitro group.

Specific examples of the compound having the formula (21) include, but are not limited to, 9-ethylcarbazole-3-carboaldehyde-1-methyl-1-phenylhydrazone, 9-ethylcarbazole-3-carboaldehyde-1-benzyl-1-phenylhydrazone, and 9-ethylcarbazole-3-carboaldehyde-1,1-diphenylhydrazone.

(22)

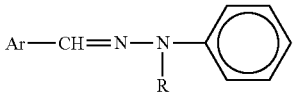

wherein Ar represents a naphthalene ring or a substitution thereof, an anthracene ring or a substitution thereof, a pyrene ring or a substitution thereof, a pyridine ring, a furan ring, or a thiophene ring; and R represents an alkyl group, a phenyl group, or a benzyl group.

Specific examples of the compound having the formula (22) include, but are not limited to, 4-diethylaminostyryl-β-carboaldehyde-1-methyl-1-phenylhydrazone, 4-methoxynaphthalene-1-carboaldehyde-1-benzyl-1-phenylhydrazone.

(23)

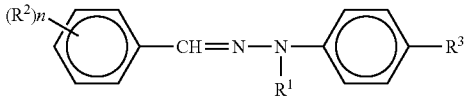

wherein $R^1$ represents an alkyl group, a benzyl group, a phenyl group, or a naphthyl group; $R^2$ represents a hydrogen atom, an alkyl group having 1 to 3 carbon atoms, an alkoxy group having 1 to 3 carbon atoms, a dialkylamino group, a diaralkylamino group, or a diarylamino group; n represents an integer of from 1 to 4; when n is 2 or more, multiple $R^2$ may be, but need not necessarily be, the same; and $R^3$ represents a hydrogen atom or a methoxy group.

Specific examples of the compound having the formula (23) include, but are not limited to, 4-methoxybenzaldehyde-1-methyl-1-phenylhydrazone, 2,4-dimethoxybenzaldehyde-1-benzyl-1-phenylhydrazone, 4-diethylaminobenzaldehyde-1,1-diphenylhydrazone, 4-methoxybenzaldehyde-1-(4-methoxy)phenylhydrazone, 4-diphenylaminobenzaldehyde-1-benzyl-1-phenylhydrazone, and 4-dibenzylaminobenzaldehyde-1,1-diphenylhydrazone.

(24)

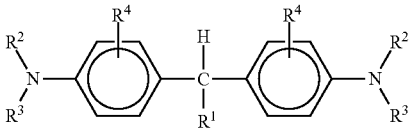

wherein $R^1$ represents an alkyl group having 1 to 11 carbon atoms, a substituted or unsubstituted phenyl group, or a heterocyclic group; each of $R^2$ and $R^3$ independently represents a hydrogen atom, an alkyl group having 1 to 4 carbon atoms, a hydroxyalkyl group, a chloroalkyl group, or a substituted or unsubstituted aralkyl group; $R^2$ and $R^3$ may share bond connectivity to form a heterocyclic ring containing a nitrogen atom; each of multiple $R^4$ independently represents a hydrogen atom, an alkyl group having 1 to 4 carbon atoms, an alkoxy group, or a halogen atom.

Specific examples of the compound having the formula (24) include, but are not limited to, 1,1-bis(4-dibenzylaminophenyl)propane, tris(4-diethylaminophenyl)methane, and 2,2'-dimethyl-4,4'-bis(diethylamino)-triphenylmethane.

(25)

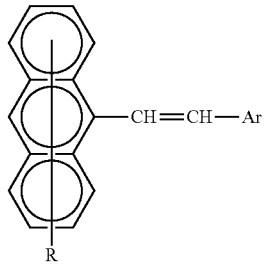

wherein R represents a hydrogen atom or a halogen atom; and Ar represents a substituted or unsubstituted phenyl, naphthyl, anthryl, or carbazolyl group.

Specific examples of the compound having the formula (25) include, but are not limited to, 9-(4-diethylaminostyryl) anthracene and 9-bromo-10-(4-diethylaminostyryl)anthracene.

(26)

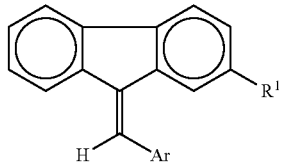

wherein $R^1$ represents a hydrogen atom, a halogen atom, a cyano group, an alkoxy group having 1 to 4 carbon atoms, or an alkyl group having 1 to 4 carbon atoms; and Ar represents a group having the following formula (27) or (28):

(27)

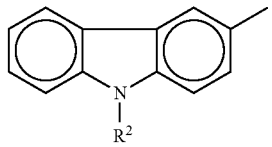

(28)

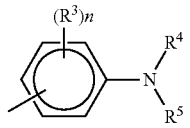

wherein $R^2$ represents an alkyl group having 1 to 4 carbon atoms; $R^3$ represents a hydrogen atom, a halogen atom, an alkyl group having 1 to 4 carbon atoms, an alkoxy group having 1 to 4 carbon atoms, or a dialkylamino group; n represents an integer of 1 or 2; when n is 2, multiple $R^3$ may be, but need not necessarily be, the same; and each of $R^4$ and $R^5$ independently represents a hydrogen atom, a substituted or unsubstituted alkyl group having 1 to 4 carbon atoms, or a substituted or unsubstituted benzyl group.

Specific examples of the compound having the formula (26) include, but are not limited to, 9-(4-dimethylaminobenzylidene)fluorenone and 3-(9-fluorenylidene)-9-ethylcarbazole.

(29)

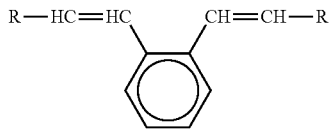

wherein R represents a carbazolyl group, a pyridyl group, a thienyl group, an indolyl group, a furyl group, a substituted or unsubstituted phenyl group, a substituted or unsubstituted styryl group, a substituted or unsubstituted naphthyl group, or a substituted or unsubstituted anthryl group; and substituent groups thereof are selected from the group consisting of a dialkylamino group, an alkyl group, an alkoxy group, a carboxyl group or an ester thereof, a halogen atom, a cyano group, an aralkylamino group, an N-alkyl-N-aralkylamino group, an amino group, a nitro group, and an acetylamino group.

Specific examples of the compound having the formula (29) include, but are not limited to, 1,2-bis(4-diethylaminostyryl)benzene and 1,2-bis(2,4-dimethoxystyryl)benzene.

(30)

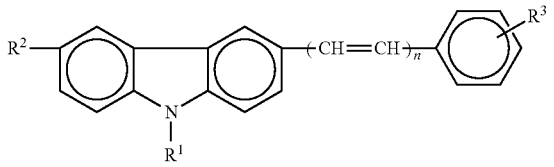

wherein $R^1$ represents a lower alkyl group, a substituted or unsubstituted phenyl group, or a benzyl group; each of $R^2$ and $R^3$ independently represents a hydrogen atom, a lower alkyl group, a lower alkoxy group, a halogen atom, a nitro group, an amino group, or an amino group substituted with a lower alkyl group or a benzyl group; and n represents an integer of 1 or 2.

Specific examples of the compound having the formula (30) include, but are not limited to, 3-styryl-9-ethylcarbazole and 3-(4-methoxystyryl)-9-ethylcarbazole.

(31)

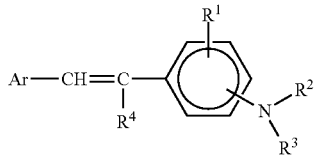

wherein $R^1$ represents a hydrogen atom, an alkyl group, an alkoxy group, or a halogen atom; each of $R^2$ and $R^3$ independently represents a substituted or unsubstituted aryl group; $R^4$ represents a hydrogen atom, a lower alkyl group, or a substituted or unsubstituted phenyl group; and Ar represents a substituted or unsubstituted phenyl or naphthyl group.

Specific examples of the compound having the formula (31) include, but are not limited to, 4-diphenylaminostilbene, 4-dibenzylaminostilbene, 4-ditolylaminostilbene, and 1-(4-diphenylaminostyryl)naphthalene.

(32)

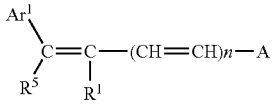

wherein n represents an integer of 0 or 1; $R^1$ represents a hydrogen atom, an alkyl group, or a substituted or unsubstituted phenyl group; $Ar^1$ represents a substituted or unsubstituted aryl group; $R^5$ represents a substituted or unsubstituted alkyl group or a substituted or unsubstituted aryl group; and A represents a group having the following formula (33), a group having the following formula (34), a 9-anthryl group, or a substituted or unsubstituted carbazolyl group:

(33)

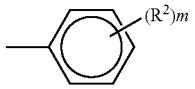

(34)

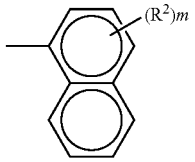

wherein $R^2$ represents a hydrogen atom, an alkyl group, an alkoxy group, a halogen atom, or a group having the following formula (35):

(35)

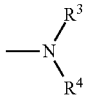

wherein each of $R^3$ and $R^4$ independently represents a substituted or unsubstituted aryl group; $R^3$ and $R^4$ may share bond connectivity to form a ring; m represents an integer of from 1 to 3; when m is 2 or more, multiple $R^2$ may be, but need not necessarily be, the same; and when n is 0, A and $R^1$ may share bond connectivity to form a ring.

Specific examples of the compound having the formula (32) include, but are not limited to, 4'-diphenylamino-α-phenylstilbene and 4'-bis(4-methylphenyl)amino-α-phenylstilbene.

(36)

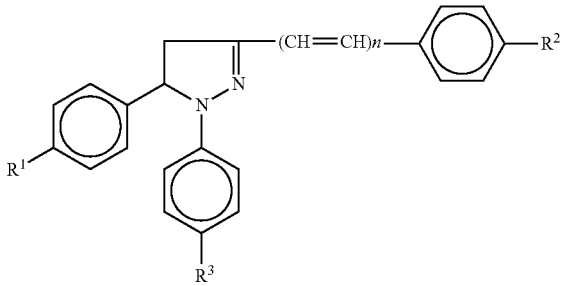

wherein each of $R^1$, $R^2$, and $R^3$ independently represents a hydrogen atom, a lower alkyl group, a lower alkoxy group, a halogen atom, or a dialkylamino group; and n represents an integer of 0 or 1.

Specific examples of the compound having the formula (36) include, but are not limited to, 1-phenyl-3-(4-diethylaminostyryl)-5-(4-diethylaminophenyl)pyrazoline.

(37)

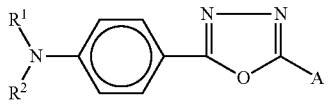

wherein each of $R^1$ and $R^2$ independently represents a substituted or unsubstituted alkyl group or a substituted or unsubstituted aryl group; and A represents a substituted amino group, a substituted or unsubstituted aryl group, or a substituted or unsubstituted allyl group.

Specific examples of the compound having the formula (37) include, but are not limited to, 2,5-bis(4-diethylaminophenyl)-1,3,4-oxadiazole, 2-N,N-diphenylamino-5-(4-diethylaminophenyl)-1,3,4-oxadiazole, and 2-(4-dimethylaminophenyl)-5-(4-diethylaminophenyl)-1,3,4-oxadiazole.

(38)

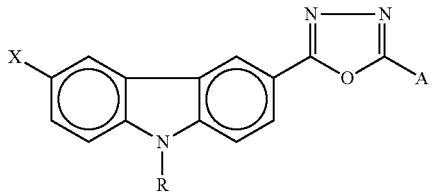

wherein X represents a hydrogen atom, a lower alkyl group, or a halogen atom; R represents a substituted or unsubstituted alkyl group or a substituted or unsubstituted aryl group; and A represents a substituted amino group or a substituted or unsubstituted aryl group.

Specific examples of the compound having the formula (38) include, but are not limited to, 2,-N,N-diphenylamino-5-(N-ethylcarbazole-3-yl)-1,3,4-oxadiazole and 2-(4-diethylaminophenyl)-5-(N-ethylcarbazole-3-yl)-1,3,4-oxadiazole.

(39)

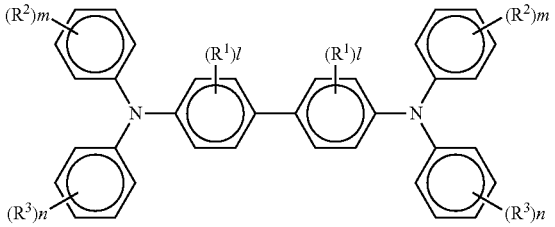

wherein $R^1$ represents a lower alkyl group, a lower alkoxy group, or a halogen atom; each of $R^2$ and $R^3$ independently represents a hydrogen atom, a lower alkyl group, a lower alkoxy group, or a halogen atom; and each of l, m, and n independently represents an integer of from 0 to 4.

Specific examples of the benzidine compound having the formula (39) include, but are not limited to, N,N'-diphenyl-N,N'-bis(3-methylphenyl)-[1,1'-biphenyl]-4,4'-diamine and 3,3'-dimethyl-N,N,N',N'-tetrakis(4-methylphenyl)-[1,1'-biphenyl]-4,4'-diamine.

(40)

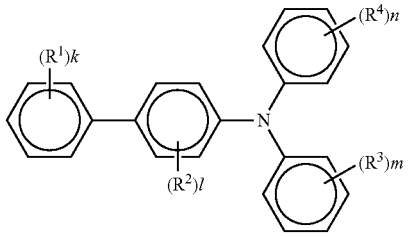

wherein each of $R^1$, $R^3$, and $R^4$ independently represents a hydrogen atom, an amino group, an alkoxy group, a thioalkoxy group, an aryloxy group, a methylenedioxy group, a substituted or unsubstituted alkyl group, a halogen atom, or a substituted or unsubstituted aryl group; $R^2$ represents a hydrogen atom, an alkoxy group, a substituted or unsubstituted alkyl group, or a halogen atom; each of $R^1$, $R^2$, $R^3$, and $R^4$ does not represent a hydrogen atom simultaneously; each of k, l, m, and n independently represents an integer of from 1 to 4; and when each of k, l, m, and n is an integer of from 2 to 4, multiple $R^1$, $R^2$, $R^3$, and $R^4$ may be, but need not necessarily be, the same.

Specific examples of the biphenylylamine compound having the formula (40) include, but are not limited to, 4'-methoxy-N,N-diphenyl-[1,1'-biphenyl]-4-amine, 4'-methyl-N,N-bis(4-methylphenyl)-[1,1'-biphenyl]-4-amine, 4'-methoxy-N,N-bis(4-methylphenyl)-[1,1'-biphenyl]-4-amine, and N,N-bis(3,4-dimethylphenyl)-[1,1'-biphenyl]-4-amine.

(41)

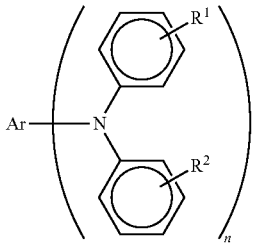

wherein Ar represents a condensed polycyclic hydrocarbon group having 18 or less carbon atoms which may have a substituent group; each of $R^1$ and $R^2$ independently represents a hydrogen atom, a halogen atom, a substituted or unsubstituted alkyl group, an alkoxy group, or a substituted or unsubstituted phenyl group; and n represents an integer of 1 or 2.

Specific examples of the triarylamine compound having the formula (41) include, but are not limited to, N,N-diphenyl-pyrene-1-amine, N,N-di-p-tolyl-pyrene-1-amine, N,N-di-p-tolyl-1-naphthylamine, N,N-di(p-tolyl)-1-phenanthrylamine, 9,9-dimethyl-2-(di-p-tolylamino)fluorene, N,N,N',N'-tetrakis(4-methylphenyl)-phenanthrene-9,10-diamine, and N,N,N',N'-tetrakis(3-methylphenyl)-m-phenylenediamine.

A–CH═CH–Ar—CH═CH–A (42)

wherein Ar represents a substituted or unsubstituted aromatic hydrocarbon group; and A represents a group having the following formula (43):

(43)

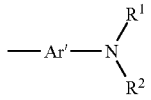

wherein Ar' represents a substituted or unsubstituted aromatic hydrocarbon group; and each of $R^1$ and $R^2$ independently represents a substituted or unsubstituted alkyl group or a substituted or unsubstituted aryl group.

Specific examples of the diolefin aromatic compound having the formula (42) include, but are not limited to, 1,4-bis(4-diphenylaminostyryl)benzene and 1,4-bis[4-di(p-tolyl)aminostyryl]benzene.

(44)

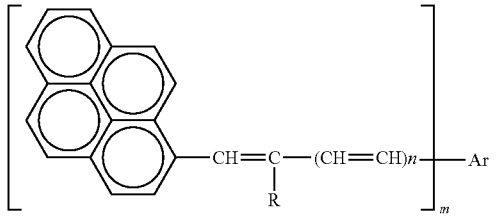

wherein Ar represents a substituted or unsubstituted aromatic hydrocarbon group; R represents a hydrogen atom, a substituted or unsubstituted alkyl group, or a substituted or unsubstituted aryl group; n represents an integer of 0 or 1 and m represents an integer of 1 or 2; and when n is 0 and m is 1, Ar and R may share bond connectivity to form a ring.

Specific examples of the styrylpyrene compound having the formula (44) include, but are not limited to, 1-(4-diphenylaminostyryl)pyrene and 1-(N,N-di-p-tolyl-4-aminostyryl)pyrene.

Specific preferred examples of suitable electron transport materials include, but are not limited to, chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and the compounds having the following formulae (45) to (48). These charge transport materials can be used alone or in combination.

(45)

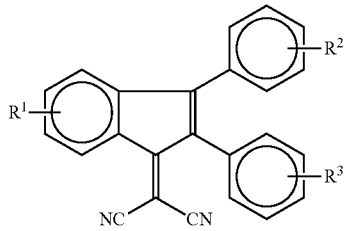

wherein each of $R^1$, $R^2$, and $R^3$ independently represents a hydrogen atom, a halogen atom, a substituted or unsubstituted alkyl group, an alkoxy group, or a substituted or unsubstituted phenyl group.

(46)

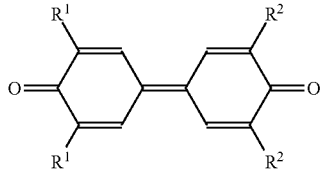

wherein each of $R^1$ and $R^2$ independently represents a hydrogen atom, a substituted or unsubstituted alkyl group, or a substituted or unsubstituted phenyl group.

(47)

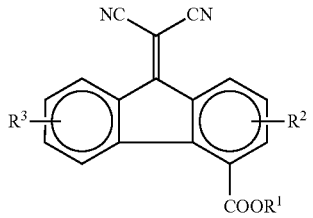

wherein each of $R^1$, $R^2$, and $R^3$ independently represents a hydrogen atom, a halogen atom, a substituted or unsubstituted alkyl group, an alkoxy group, or a substituted or unsubstituted phenyl group.

(48)

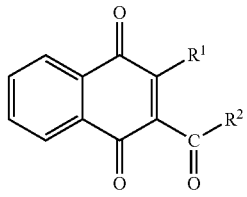

wherein $R^1$ represents an alkyl group which may have a substituent group or an aryl group which may have a substituent group; $R^2$ represents an alkyl group which may have a substituent group, an aryl group which may have a substituent group, or a group having the following formula (49):

$$—O—R^3 \quad (49)$$

wherein $R^3$ represents an alkyl group which may have a substituent group or an aryl group which may have a substituent group.

Specific examples of usable binder resins for the charge transport layer 37 include, but are not limited to, thermoplastic and thermosetting resins such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate resins, phenoxy resins, polycarbonate, cellulose acetate resins, ethylcellulose resins, polyvinyl butyral, polyvinyl formal, polyvinyl toluene, poly-N-vinylcarbazole, acrylic resins, silicone resins, epoxy resins, melamine resins, urethane resins, phenol resins, and alkyd resins.

A total amount of the charge transport material and the phthalimide isoindole derivative having the formula (1) included in the charge transport layer 37 is preferably from 20 to 300 parts by weight, and more preferably from 40 to 150 parts by weight, per 100 parts by weight of the binder resin.

The charge transport layer 37 preferably has a thickness of 25 μm or less, from the viewpoint of image resolution and responsiveness, and 5 μm or more. However, the lower limit depends on the electrophotographic system in use, in particular the charging potential.

Further, the content of the phthalimide isoindole derivative having the formula (1) is preferably from 0.01 to 150% by weight based on the charge transport material. When the content of the phthalimide isoindole derivative having the formula (1) is too small, the resultant photoreceptor has poor resistance to oxidizing gases. When the content of the phthalimide isoindole derivative having the formula (1) is too large, residual potential considerably increases by repeated use.

Specific preferred examples of suitable solvents for forming the charge transport layer 37 include, but are not limited to, tetrahydrofuran, dioxane, toluene, dichloromethane, monochlorobenzene, dichloroethane, cyclohexanone, methyl ethyl ketone, and acetone. The charge transport materials can be used alone or in combination.

The charge transport layer 37 may include an antioxidant. Specific preferred examples of suitable antioxidants include hydroquinone compounds and hindered amine compounds. Such antioxidants prevent deterioration of the phthalimide isoindole derivative having the formula (1). The antioxidant is preferably added to the coating liquid before the phthalimide isoindole derivative having the formula (1) is added thereto. The added amount of the antioxidant is preferably from 0.1 to 200% by weight based on the phthalimide isoindole derivative having the formula (1).

Charge transport polymers, which have functions of both a binder resin and a charge transport material, can be preferably used for the charge transport layer 37, because the resultant charge transport layer has good abrasion resistance. Specific preferred examples of usable charge transport polymers include, but are not limited to, polycarbonates having a triarylamine structure in a main chain and/or side chain thereof. More specifically, charge transport polymers having the following formulae (I) to (XIII) are preferable:

(I)

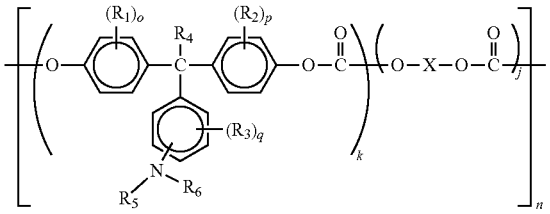

wherein each of $R_1$, $R_2$, and $R_3$ independently represents a substituted or unsubstituted alkyl group or a halogen atom; $R_4$ represents a hydrogen atom or a substituted or unsubstituted alkyl group; each of $R_5$ and $R_6$ independently represents a substituted or unsubstituted aryl group; each of o, p, and q independently represents an integer of from 0 to 4; k represents a numeral of from 0.1 to 1; j represents a numeral of from 0 to 0.9; n represents an integer of from 5 to 5,000; and X represents an aliphatic divalent group, an alicyclic divalent group, or a divalent group having the following formula (II):

(II)

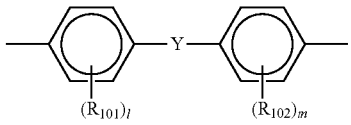

wherein each of $R_{101}$ and $R_{102}$ independently represents a substituted or unsubstituted alkyl group, an aryl group, or a halogen atom; each of 1 and m independently represents an integer of from 0 to 4; Y represents a single bond, a straight-chain, branched-chain, or cyclic alkylene group having 1 to 12 carbon atoms, —O—, —S—, —SO—, —$SO_2$—, —CO—, —CO—O—Z—O—CO— (Z represents an aliphatic divalent group), or a group having the following formula (III):

(III)

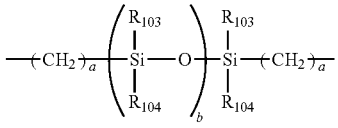

wherein a represents an integer of from 1 to 20; b represents an integer of from 1 to 2,000; and each of $R_{103}$ and $R_{104}$ independently represents a substituted or unsubstituted alkyl group or an aryl group;

(IV)

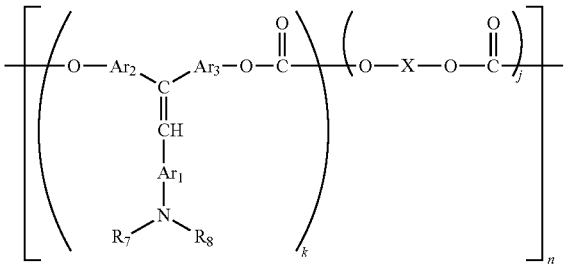

wherein each of $R_7$ and $R_8$ independently represents a substituted or unsubstituted aryl group; each of $Ar_1$, $Ar_2$, and $Ar_3$ independently represents an arylene group; and k, j, n, and X are as defined in the formula (I);

(V)

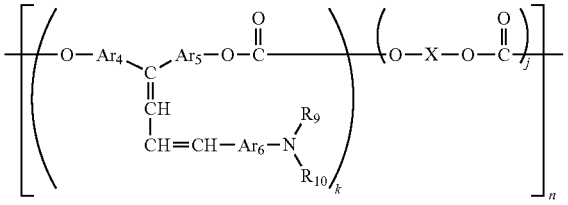

wherein each of $R_9$ and $R_{10}$ independently represents a substituted or unsubstituted aryl group; each of $Ar_4$, $Ar_5$, and $Ar_6$ independently represents an arylene group; and k, j, n, and X are as defined in the formula (I);

(VI)

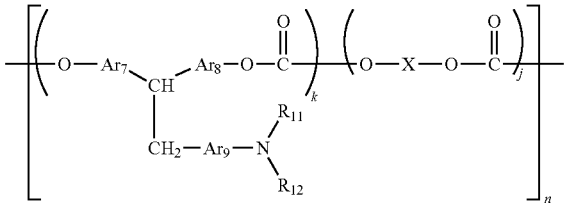

wherein each of $R_{11}$ and $R_{12}$ independently represents a substituted or unsubstituted aryl group; each of $Ar_7$, $Ar_8$, and $Ar_9$ independently represents an arylene group; p represents an integer of from 1 to 5; and k, j, n, and X are as defined in the formula (I);

(VII)

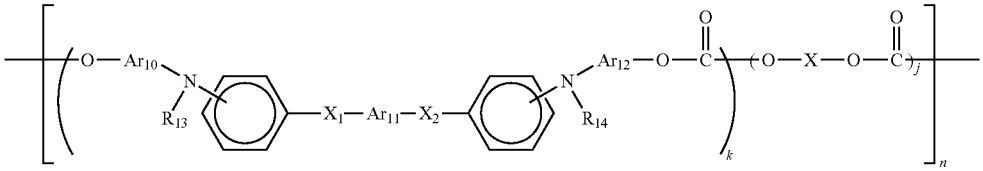

wherein each of $R_{13}$ and $R_{14}$ independently represents a substituted or unsubstituted aryl group; each of $Ar_{10}$, $Ar_{11}$, and $Ar_{12}$ independently represents an arylene group; each of $X_1$ and $X_2$ independently represents a substituted or unsubstituted ethylene group or a substituted or unsubstituted vinylene group; and k, j, n, and X are as defined in the formula (I);

(VIII)

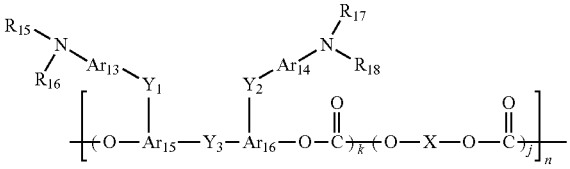

wherein each of $R_{15}$, $R_{16}$, $R_{17}$, and $R_{18}$ independently represents a substituted or unsubstituted aryl group; each of $Ar_{13}$, $Ar_{14}$, and $Ar_{16}$ independently represents an arylene group; each of $Y_1$, $Y_2$, and $Y_3$ independently represents a single bond, a substituted or unsubstituted alkylene group, a substituted or unsubstituted cycloalkylene group, a substituted or unsubstituted alkylene ether group, an oxygen atom, a sulfur atom, or a vinylene group; and k, j, n, and X are as defined in the formula (I);

(IX)

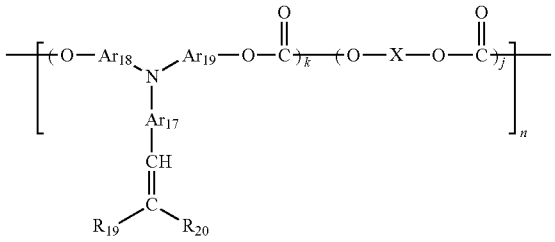

wherein each of $R_{19}$ and $R_{20}$ independently represents a hydrogen atom or a substituted or unsubstituted aryl group; $R_{19}$ and $R_{20}$ may share bond connectivity to form a ring; each of $Ar_{17}$, $Ar_{18}$, and $Ar_{19}$ independently represents an arylene group; and k, j, n, and X are as defined in the formula (I);

(X)

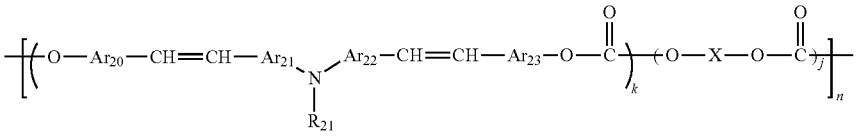

wherein $R_{21}$ represents a substituted or unsubstituted aryl group; each of $Ar_{20}$, $Ar_{21}$, $Ar_{22}$, and $Ar_{23}$ independently represents an arylene group; and k, j, n, and X are as defined in the formula (I);

(XI)

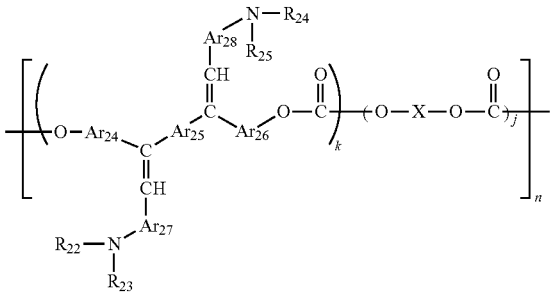

wherein each of $R_{22}$, $R_{23}$, $R_{24}$, and $R_{25}$ independently represents a substituted or unsubstituted aryl group; each of $Ar_{24}$, $Ar_{25}$, $Ar_{26}$, $Ar_{27}$, and $Ar_{28}$ independently represents an arylene group; and k, j, n, and X are as defined in the formula (I);

(XII)

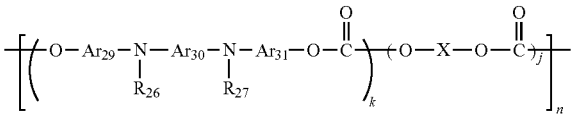

wherein each of $R_{26}$ and $R_{27}$ independently represents a substituted or unsubstituted aryl group; each of $Ar_{29}$, $Ar_{30}$, and $Ar_{31}$ independently represents an arylene group; and k, j, n, and X are as defined in the formula (I); and (XIII)

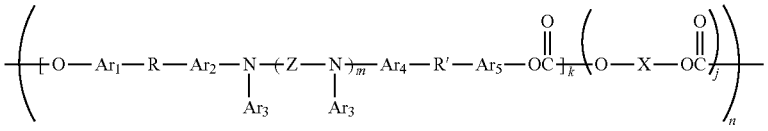

wherein each of $Ar_1$, $Ar_2$, $Ar_3$, $Ar_4$ and $Ar_5$ independently represents a substituted or unsubstituted aromatic group; Z represents an aromatic group or —$Ar_6$-Za-$Ar_6$—, wherein $Ar_6$ represents a substituted or unsubstituted aromatic group and Za represents O, S, or an alkylene group; each of R and R' independently represents a straight-chain or branched-chain alkylene group; m represents an integer of 0 or 1; and k, j, n, and X are as defined in the formula (I).

The charge transport layer 37 may be prepared by applying a charge transport layer coating liquid on the charge generation layer 35, followed by drying. The charge transport layer coating liquid may be prepared by dissolving or dispersing a charge transport material in a solvent optionally together with a binder resin. The charge transport layer coating liquid may optionally include one or more of a plasticizer, a leveling agent, antioxidant, and the like.

Suitable coating methods include, but are not limited to, a dip coating method, a spray coating method, a bead coating method, a nozzle coating method, a spinner coating method, and a ring coating method.

Description is now made of the photosensitive layer 33 which is a single layer. The photosensitive layer 33 may be formed by applying a coating liquid on a conductive substrate, followed by drying. The coating liquid may be prepared by dispersing or dissolving a charge generation material, a charge transport material, a binder resin in a solvent. The coating liquid may optionally include a plasticizer, a leveling agent, an antioxidant, and the like.

Suitable materials for the binder resin in the single-layered photosensitive layer 33 include the above-described materials suitable for the binder resin in the charge generation layer 35 and the charge transport layer 37. In addition, the charge transport polymers described above are also preferable for the single-layered photosensitive layer 33. The content of the charge generation material is preferably from 5 to 40 parts by weight, and the content of the charge transport material is preferably from 0 to 190 parts by weight, and more preferably from 50 to 150 parts by weight, per 100 parts by weight of the binder resin included in the layer.

The single-layered photosensitive layer 33 may be prepared by applying a coating liquid, which may be prepared by dissolving or dispersing a charge generation material, a binder resin, and optionally together with a charge transport material in a solvent such as tetrahydrofuran, dioxane, dichloroethane, and cyclohexane, using a dispersing machine. Suitable coating methods include a dip coating method, a spray coating method, a bead coating method, a ring coating method, and the like. The photosensitive layer 33 preferably has a thickness of from 5 to 25 μm.

The photoreceptor according to this specification may optionally include an undercoat layer between the conductive substrate 31 and the photosensitive layer 33. The undercoat layer typically includes a resin as a main component. Since the photosensitive layer 33 is typically formed on the undercoat layer by a wet coating method, the undercoat layer preferably has good resistance to the solvent included in the coating liquid of the photosensitive layer 33. Suitable resins for use in the undercoat layer include, but are not limited to, water-soluble resins such as polyvinyl alcohol, casein, and sodium polyacrylate; alcohol-soluble resins such as copolymer nylon and methoxymethylated nylon; and cured resins having a three-dimensional network structure, such as polyurethane, melamine resins, phenol resins, alkyd-melamine resins, and epoxy resins.

In addition, to prevent the occurrence of moiré and to decrease residual potential, the undercoat layer may include fine powders of metal oxides such as titanium oxide, silica, alumina, zirconium oxide, tin oxide, and indium oxide.

The undercoat layer may be prepared by a typical coating method using a proper solvent, in the same way as the preparation of the photosensitive layer 33. In addition, a metal oxide layer prepared by a sol-gel method using a silane coupling agent, a titan coupling agent, or a chrome coupling agent, may also be used as the undercoat layer. Furthermore, $Al_2O_3$ prepared by anodic oxidization; and thin films of organic materials such as polyparaxylylene (parylene) and inorganic materials such as $SiO_2$, $SnO_2$, $TiO_2$, ITO, and $CeO_2$ prepared by a vacuum method may also be used as the undercoat layer. The undercoat layer preferably has a thickness of from 0 to 5 μm.

The protective layer 39 may be formed on the photosensitive layer to protect the photosensitive layer 33. Specific preferred examples of suitable binder resins used in the protective layer 39 include ABS resins, ACS resins, olefin-vinyl monomer copolymers, chlorinated polyether, aryl resins, phenol resins, polyacetal, polyamide, polyamideimide, polyacrylate, polyallylsulfone, polybutylene, polybutylene terephthalate, polycarbonate, polyether sulfone, polyethylene, polyethylene terephthalate, polyimide, acrylic resins, polymethylpentene, polypropylene, polyphenylene oxide, polysulfone, polystyrene, polyarylate, AS resins, butadiene-styrene copolymers, polyurethane, polyvinyl chloride, polyvinylidene chloride, and epoxy resins. Among these resins, polycarbonate and polyarylate are preferable from the viewpoint of dispersibility of a filler, residual potential, and coating defect.

The protective layer 39 further includes a filler to improve abrasion resistance. Specific preferred examples of suitable solvents for forming the protective layer 39 include, but are not limited to, tetrahydrofuran, dioxane, toluene, dichloromethane, monochlorobenzene, dichloroethane, cyclohexanone, methyl ethyl ketone, and acetone. These suitable solvents are identical to those suitable for forming the charge transport layer 37. A high-viscosity solvent is preferable in view of dispersion efficiency of a coating liquid, whereas a highly-volatile solvent is preferable in view of coating reliability. If there is no solvent having both high viscosity and high volatile, 2 or more solvents can be used in combination. Solvents may have a large effect on dispersibility of fillers and residual potential.

Further, the protective layer 39 may include the phthalimide isoindole derivative having the formula (1). Moreover, the above-described low-molecular-weight charge transport materials and charge transport polymers preferable for the charge transport layer 37 may be added to the protective layer 39 to more reduce residual potential and to more improve image quality.

The protective layer 39 may be formed by typical coating methods such as a dip coating method, a spray coating method, a bead coating method, a nozzle coating method, a spinner coating method, and a ring coating method. Among these methods, a spray coating method is preferable from the viewpoint of uniform coating.

The photoreceptor of the present invention may optionally include an intermediate layer between the photosensitive layer 33 and the protective layer 39. The intermediate layer typically includes a binder resin as a main component. Specific preferred examples of suitable binder resins include, but are not limited to, polyamide, alcohol-soluble nylon, water-soluble polyvinyl butyral, polyvinyl butyral, and polyvinyl alcohol. The intermediate layer may be formed by a typical coating method as described above. The intermediate layer preferably has a thickness of from 0.05 to 2 μm.

The charge generation layer, charge transport layer, photosensitive layer, undercoat layer, protective layer, and intermediate layer each may optionally include an antioxidant, a plasticizer, a lubricant, an ultraviolet absorber, and/or a leveling agent for the purpose of improving environmental stability and preventing deterioration of sensitivity and increase of residual potential.

Specific examples of suitable antioxidants include the following compounds, but are not limited thereto.

(a) Phenol compounds (including hindered phenols): such as 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, and tocopherols.

(b) HALS (hindered amines): such as bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetramethylpyridine, 8-benzyl-7,7,9,9-tetramethyl-3-octyl-1,3,8-triazaspiro[4,5]undecane-2,4-dione, and 4-benzoyloxy-2,2,6,6-tetramethylpyridine.

(c) Paraphenylenediamines: such as N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

(d) Hydroquinones: such as 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

(e) Organic sulfur compounds: such as dilauryl-3,3'-thiodipropionate, distearyl-3,3'-thiodipropionate, and ditetradecyl-3,3'-thiodipropionate.

(f) Organic phosphor compounds: such as triphenylphosphine, tri(nonylphenyl)phosphine, tri(dinonylphenyl)phosphine, tricresylphosphine, and tri(2,4-dibutylohenoxy)phosphine.

Specific examples of suitable plasticizers include the following compounds, but are not limited thereto.

(a) Phosphate plasticizers: such as triphenyl phosphate, tricresyl phosphate, trioctyl phosphate, octyl diphenyl phosphate, trichloroethyl phosphate, cresyl diphenyl phosphate, tributyl phosphate, tri-2-ethylhexyl phosphate, and triphenyl phosphate.

(b) Phthalate plasticizers: such as dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butyl benzyl phthalate, butyl lauryl phthalate, methyl oleyl phthalate, octyl decyl phthalate, dibutyl phthalate, and dioctyl phthalate.

(c) Aromatic carboxylate plasticizers: such as trioctyl trimellitate, tri-n-octyl trimellitate, and octyl oxybenzoate.

(d) Dibasic esters of aliphatic series: such as dibutyl adipate, di-n-hexyl adipate, di-2-ethylhexyl adipate, n-octyl adipate, n-octyl-n-decyl adipate, diisodecyl adipate, dicapryl adipate, di-2-ethylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, and di-n-octyl tetrahydrophthalate.

(e) Fatty acid ester derivatives: such as butyl oleate, glycerin monooleate, methyl acetylricinolate, pentaerythritol esters, dipentaerythritol hexaesters, triacetin, and tributyrin.

(f) Oxyacid ester plasticizers: such as methyl acetylricinolate, butyl acetylricinolate, butyl phthalyl butyl glycolate, and tributyl acetylcitrate.

(g) Epoxy plasticizers: such as epoxidized soybean oil, epoxidized linseed oil, butyl epoxystearate, decyl epoxystearate, octyl epoxystearate, benzyl epoxystearate, dioctyl epoxyhexahydrophthalate, didecyl and epoxyhexahydrophthalate.

(h) Divalent alcohol ester plasticizers: such as diethylene glycol dibenzoate and triethylene glycol di-2-ethylbutyrate.

(i) Chlorine-containing plasticizers: such as chlorinated paraffin, chlorinated diphenyl, methyl esters of chlorinated fatty acids, and methyl esters of methoxychlorinated fatty acids.

(j) Polyester plasticizers: such as polypropylene adipate, polypropylene sebacate, polyester, and acetylated polyester.

(k) Sulfonic acid derivatives: such as p-toluene sulfonamide, o-toluene sulfonamide, p-toluene sulfonethylamide, o-toluene sulfonethylamide, toluenesulfon-N-ethylamide, and p-toluenesulfon-N-cyclohexylamide.

(l) Citric acid derivatives: such as triethyl citrate, triethyl acetylcitrate, tributyl citrate, tributyl acetylcitrate, tri-2-ethylhexyl acetylcitrate, and n-octyldecyl acetylcitrate.

(m) Others: such as terphenyl, partially hydrated terphenyl, camphor, 2-nitrodiphenyl, dinonyl naphthalene, and methyl abietate.

Specific examples of suitable lubricants include the following compounds, but are not limited thereto.

(a) Hydrocarbon compounds: such as liquid paraffin, paraffin wax, micro wax, and low-polymerization polyethylene.

(b) Fatty acid compounds: such as lauric acid, myristic acid, palmitic acid, stearic acid, arachidic acid, and behenic acid.

(c) Fatty acid amide compounds: such as stearyl amide, palmitic acid amide, oleic acid amide, methylenebis stearamide, and ethylenebis stearamide.

(d) Ester compounds: such as lower alcohol esters of fatty acids, polyol esters of fatty acids, and polyglycol esters of fatty acids.

(e) Alcohol compounds: such as cetyl alcohol, stearyl alcohol, ethylene glycol, polyethylene glycol, and polyglycerol.

(f) Metallic soaps: such as lead stearate, cadmium stearate, barium stearate, calcium stearate, zinc stearate, and magnesium stearate.

(g) Natural waxes: such as carnauba wax, candelilla wax, beeswax, spermaceti, insect wax, and montan wax.

(h) Others: such as silicone compounds and fluorine compounds.

Specific examples of suitable ultraviolet absorbers include the following compounds, but are not limited thereto.

(a) Benzophenones: such as 2-hydroxybenzophenone, 2,4-dihydroxybenzophenone, 2,2',4-trihydroxybenzophenone, 2,2',4,4'-tetrahydroxybenzophenone, and 2,2'-dihydroxy-4-methoxybenzophenone.

(b) Salicylates: such as phenyl salicylate and 2,4-di-t-butylphenyl-3,5-di-t-butyl-4-hydroxybenzoate.

(c) Benzotriazoles: such as (2'-hydroxyphenyl)benzotriazole, (2'-hydroxy-5'-methylphenyl)benzotriazole, and (2'-hydroxy-3'-tert-butyl-5'-methylphenyl)-5-chlorobenzotriazole.

(d) Cyanoacrylates: such as ethyl-2-cyano-3,3-diphenyl acrylate and methyl-2-carbomethoxy-3(paramethoxy) acrylate.

(e) Quenchers (i.e., metal complexes): such as nickel(2,2'-thiobis(4-t-octyl)phenolate)n-butylamine, nickel dibutyldithiocarbamate, and cobalt dicyclohexyldithiophosphate.

Next, exemplary embodiments of the electrophotographic image forming method and the electrophotographic image forming apparatus according to this specification are described in detail below.

Figure 7:
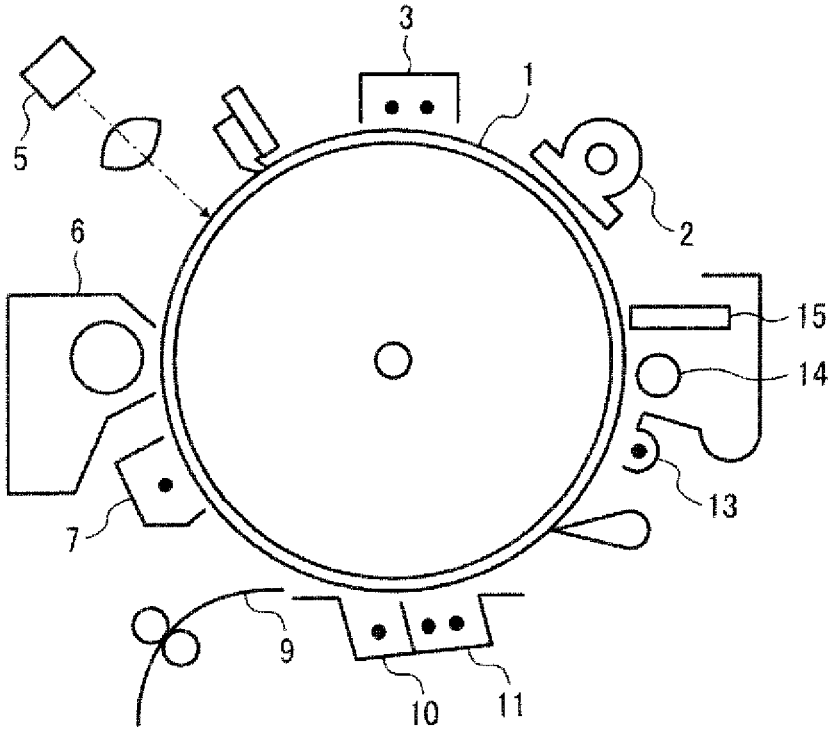
FIG. 7 is a schematic view illustrating an embodiment of the electrophotographic image forming apparatus according to this specification.

FIG. 7 is a schematic view illustrating an embodiment of the electrophotographic image forming apparatus according to this specification.

A photoreceptor 1 illustrated in FIG. 7 has a drum-like shape. Alternatively, the photoreceptor 1 may have a sheet-like shape or an endless-belt-like shape. Each of a charger 3, a pre-transfer charger 7, a transfer charger 10, a separation charger 11, and a pre-cleaning charger 13, may be a charger such as a corotron, a scorotron, a solid state charger, or a charging roller, for example.

A transfer device is preferably comprised of the transfer charger 10 and the separation charger 11, as illustrated in FIG. 7. Alternatively, the transfer device may be one of the chargers described above.

Suitable light sources for an irradiator 5 and a decharging lamp 2 include illuminants such as a fluorescent lamp, a tungsten lamp, a halogen lamp, a mercury lamp, a sodium lamp, a light-emitting diode (LED), a laser diode (LD), and an electroluminescence (EL). In order to obtain light having a desired wave length range, filters such as a sharp-cut filter, a band pass filter, a near-infrared cutting filter, a dichroic filter, an interference filter, and a color temperature converting filter, can be used.

In a case where a transfer process, a decharging process, and/or a cleaning process are performed along with light irradiation, or a pre-irradiation process is provided, the photoreceptor 1 may be irradiated with light emitted from the above-described light sources in such processes.

A toner image formed on the photoreceptor 1 by a developing unit 6 is transferred onto a transfer paper 9. Some toner particles may remain on the photoreceptor 1 without being transferred onto the transfer paper 9. Such residual toner particles are removed using a cleaning brush 14 and a blade 15. Alternatively, removal of residual toner particles may be performed using only the cleaning brush 14. The cleaning brush 14 may be a fur brush or a magnet fur brush, for example.

Generally, when the photoreceptor 1 is positively (negatively) charged and irradiated with light, a positive (negative) electrostatic latent image is formed thereon. When the positive (negative) electrostatic latent image is developed with a negatively (positively) chargeable toner, a positive image is produced. By contrast, when the positive (negative) electrostatic latent image is developed with a positively (negatively) chargeable toner, a negative image is produced.

Figure 8:
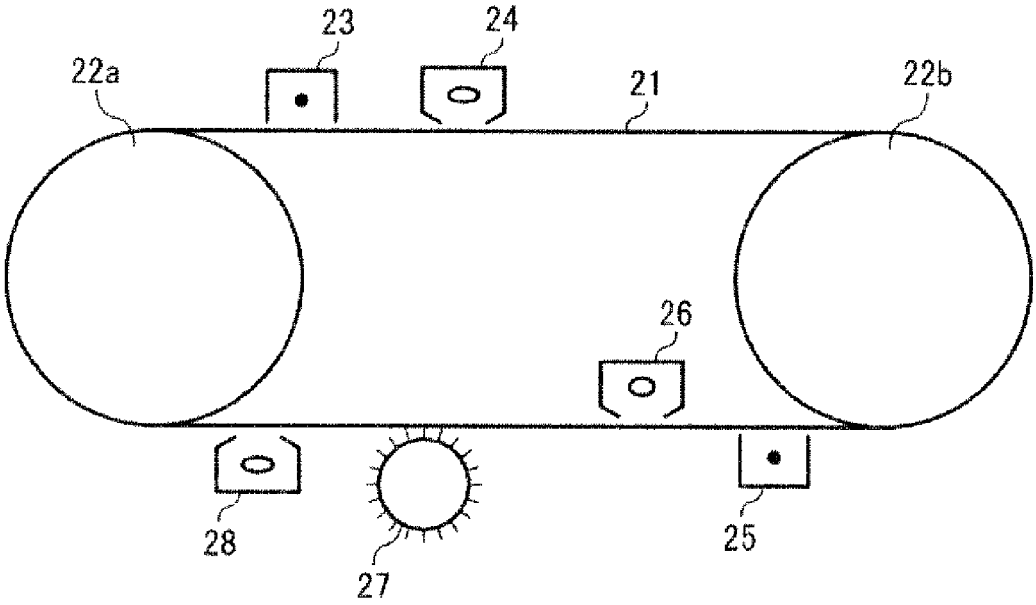
FIG. 8 is a schematic view illustrating another embodiment of the electrophotographic image forming apparatus according to this specification.

FIG. 8 is a schematic view illustrating another embodiment of the electrophotographic image forming apparatus according to this specification.

A photoreceptor 21 includes a photosensitive layer. The photoreceptor 21 is driven by driving rollers 22*a* and 22*b*, charged by a charger 23, and irradiated with a light beam emitted from an image irradiator 24. A toner image is formed on the photoreceptor 21 by a developing device, not shown, and then transferred onto a transfer paper, not shown, by a transfer charger 25. The photoreceptor 21 is then irradiated with a light beam emitted from a pre-cleaning irradiator 26, cleaned by a brush 27, and decharged by a decharging irradiator 28. The above-described operation is repeatedly performed. As illustrated in FIG. 8, the pre-cleaning irradiator 26 irradiates the photoreceptor 21 from a side on which the substrate is provided. In this case, of course, the substrate is translucent.

Alternatively, the pre-cleaning irradiator 26 may irradiate the photoreceptor 21 from a side on which the photosensitive layer is provided. Each of the image irradiator 24 and the decharging irradiator 28 may irradiate the photoreceptor 21 from a side on which a substrate is provided.

Further, in addition to the image irradiator 24, the pre-cleaning irradiator 26, and the decharging irradiator 28, a pre-transfer irradiator and a pre-irradiator may also be provided.

Figure 9:
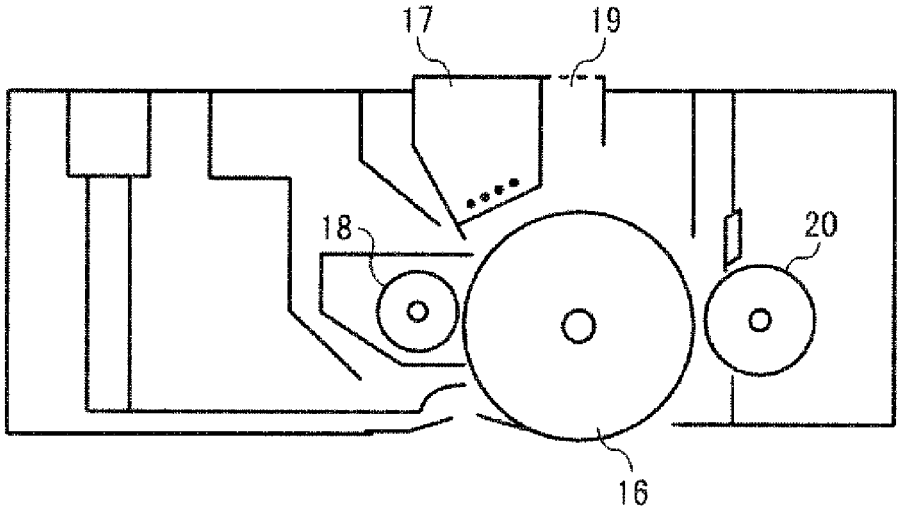
FIG. 9 is a schematic view illustrating an embodiment of the process cartridge according to this specification.

The above-described image forming members and devices may be fixedly mounted on the image forming apparatus such as a copier, a facsimile, and a printer. Alternatively, the above-described image forming members and devices may be integrally combined as a process cartridge. An exemplary embodiment of the process cartridge includes a single device (i.e., component) including a photoreceptor, a charger, an irradiator, a developing device, a transfer device, a cleaning device, and a decharging device. FIG. 9 is a schematic view illustrating an embodiment of the process cartridge according to this specification, including a photoreceptor 16 according to this specification, a charger 17, a cleaning brush 18, an image irradiator 19, and a developing roller 20. The photoreceptor 16 comprises a conductive substrate and a photosensitive layer formed on the conductive substrate.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis Example of Phthalimide Isoindole Derivative

A 140-ml flask is charged with 12.02 g (40 mmol) of 4,7-dihydro-5,6-dimethyl-1,3-diphenylbenzofuran, 7.13 g (44 mmol) of N-aminophthalimide (from Tokyo Chemical Industry Co., Ltd.), 22.11 g (160 mmol) of potassium carbonate, and 140 ml of dichloromethane. The flask is cooled to 0 to 5° C. in ice, while agitating the mixture. Then 19.51 g (44 mmol) of lead (IV) tetraacetate (from Tokyo Chemical Industry Co., Ltd.) is gradually added to the flask over a period of 1 hour, while keeping the temperature of the mixture to 0 to 5° C. The mixture is further agitated for 5 hours while cooling in ice, and subsequently subjected to suction filtration. The filtered solid components are extracted with dichloromethane, and the resultant extract is added to the filtrate. Solvents are removed from the resulting mixture under reduced pressures.

After adding 0.190 g (1 mmol) of p-toluene sulfonic acid and 160 ml of toluene, the resulting mixture is subjected to heat reflux for 2 hours, followed by cooling. After separating insoluble components by filtration, the mixture is purified by silica gel chromatography, and is further recrystallized using a mixed solvent of ethanol and dichloromethane. Thus, 10.51 g of a phthalimide isoindole derivative having the following formula (equivalent to the above-described compound No. 8) is prepared:

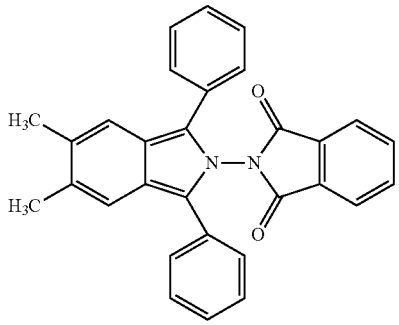

Figure 10:
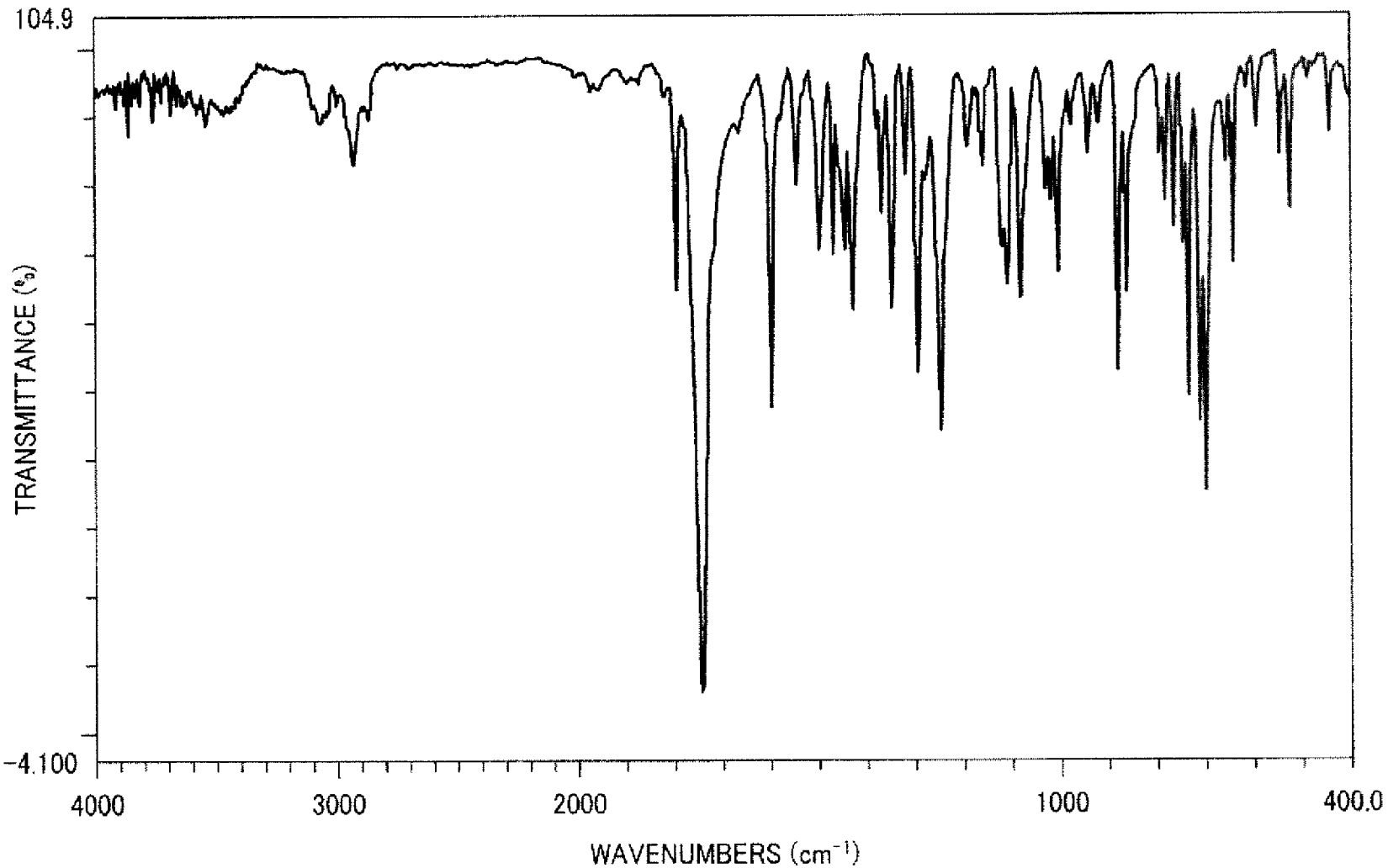
FIG. 10 shows an infrared absorption spectrum of the phthalimide isoindole derivative according to this specification.

The yield is 59.4%. The melting point of the phthalimide isoindole derivative is from 219.0 to 220° C. The infrared absorption spectrum of the phthalimide isoindole derivative is shown in FIG. 10.

Example 1

An undercoat layer coating liquid, a charge generation layer coating liquid, and a charge transport layer coating liquid, each having the following compositions, are successively applied to an aluminum cylinder and dried, in this order. Thus, a photoreceptor No. 1 including an undercoat layer having a thickness of 3.5 μm, a charge generation layer having a thickness of 0.2 μm, and a charge transport layer having a thickness of 23 μm is prepared.

(Composition of Undercoat Layer Coating Liquid)

| | |
|---|---|
| Titanium dioxide powder (TIPAQUE CR-EL from Ishihara Sangyo Kaisha, Ltd.) | 400 parts |
| Melamine resin (SUPER BECKAMINE G821-60 from DIC Corporation) | 65 parts |
| Alkyd resin (BECKOLITE M6401-50 from DIC Corporation) | 120 parts |
| 2-Butanone | 400 parts |

(Composition of Charge Generation Layer Coating Liquid)

| | |
|---|---|
| Fluorenone bisazo pigment having the following formula | 12 parts |

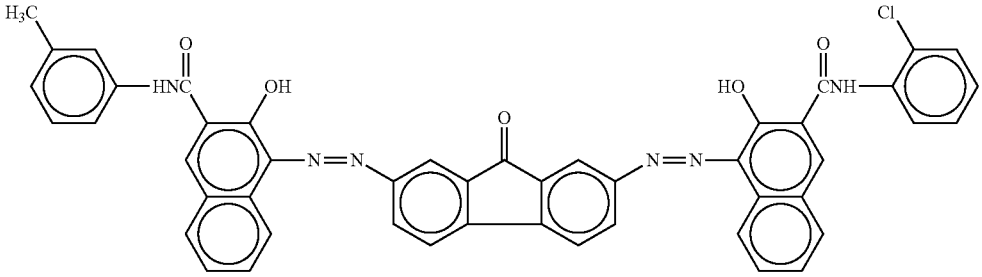

| | |
|---|---|
| Polyvinyl butyral (XYHL from Union Carbide Corporation) | 5 parts |
| 2-Butanone | 200 parts |
| Cyclohexanone | 400 parts |

(Composition of Charge Transport Layer Coating Liquid)

| | |
|---|---|
| Polycarbonate resin (Z-form polycarbonate resin from Teijin Chemicals Ltd.) | 10 parts |
| Phthalimide isoindole derivative No. 8 | 10 parts |
| Tetrahydrofuran | 100 parts |

(Evaluation)

The above-prepared photoreceptor No. 1 is mounted on an electrophotographic process cartridge, and the process cartridge is mounted on a modified image forming apparatus IMAGIO MF2200 (manufactured and modified by Ricoh Co., Ltd.) employing a positive scorotron corona charging method for charging the photoreceptor and a laser diode (LD) having a wavelength of 655 nm for image irradiation. The dark section potential is set to 800 (V). A running test in which an image is continuously produced on 100,000 sheets is performed. At the beginning of and after the running test, the produced image quality is evaluated and the bright section potential is measured.

Further, at the beginning of and after the running test, a dot image having a pixel density of 600 dpi×600 dpi and an image density of 5% is continuously produced on 10 sheets. The produced image is observed with a stereoscopic microscope to determine whether the dots are blurred or not, and the sharpness of the dot outline (i.e., dot resolution) is graded into the following five levels. The evaluation results are shown in Table 1.

5: Dot outline is clear. Very good.
4: Dot outline is blurred only slightly. Good.
3: Dot outline is blurred slightly. Average.
2: Dot outline is blurred. Poor.
1: Difficult to determine dot outline. Very poor.

Example 2

The procedure in Example 1 is repeated except for replacing the phthalimide isoindole derivative No. 8 with another phthalimide isoindole derivative No. 1. Thus, a photoreceptor No. 2 is prepared. The evaluation results are shown in Table 1.

Example 3

The procedure in Example 1 is repeated except for replacing the phthalimide isoindole derivative No. 8 with another phthalimide isoindole derivative No. 3. Thus, a photoreceptor No. 3 is prepared. The evaluation results are shown in Table 1.

Example 4

The procedure in Example 1 is repeated except for replacing the phthalimide isoindole derivative No. 8 with another phthalimide isoindole derivative No. 5. Thus, a photoreceptor No. 4 is prepared. The evaluation results are shown in Table 1.

Example 5

The procedure in Example 1 is repeated except for replacing the phthalimide isoindole derivative No. 8 with another phthalimide isoindole derivative No. 7. Thus, a photoreceptor No. 5 is prepared. The evaluation results are shown in Table 1.

Example 6

The procedure in Example 1 is repeated except for replacing the phthalimide isoindole derivative No. 8 with another phthalimide isoindole derivative No. 9. Thus, a photoreceptor No. 6 is prepared. The evaluation results are shown in Table 1.

Example 7

The procedure in Example 1 is repeated except for replacing the phthalimide isoindole derivative No. 8 with another phthalimide isoindole derivative No. 11. Thus, a photoreceptor No. 7 is prepared. The evaluation results are shown in Table 1.

Example 8

The procedure in Example 1 is repeated except for replacing the phthalimide isoindole derivative No. 8 with another phthalimide isoindole derivative No. 13. Thus, a photoreceptor No. 8 is prepared. The evaluation results are shown in Table 1.

Example 9

The procedure in Example 1 is repeated except for replacing the phthalimide isoindole derivative No. 8 with another phthalimide isoindole derivative No. 15. Thus, a photoreceptor No. 9 is prepared. The evaluation results are shown in Table 1.

Example 10

The procedure in Example 1 is repeated except for replacing the phthalimide isoindole derivative No. 8 with another phthalimide isoindole derivative No. 17. Thus, a photoreceptor No. 10 is prepared. The evaluation results are shown in Table 1.

Example 11

The procedure in Example 1 is repeated except for replacing the phthalimide isoindole derivative No. 8 with another phthalimide isoindole derivative No. 21. Thus, a photoreceptor No. 11 is prepared. The evaluation results are shown in Table 1.

Example 12

The procedure in Example 1 is repeated except for replacing the phthalimide isoindole derivative No. 8 with another phthalimide isoindole derivative No. 23. Thus, a photoreceptor No. 12 is prepared. The evaluation results are shown in Table 1.

Example 13

The procedure in Example 1 is repeated except for replacing the phthalimide isoindole derivative No. 8 with another phthalimide isoindole derivative No. 25. Thus, a photoreceptor No. 13 is prepared. The evaluation results are shown in Table 1.

Example 14

The procedure in Example 1 is repeated except for replacing the phthalimide isoindole derivative No. 8 with another phthalimide isoindole derivative No. 29. Thus, a photoreceptor No. 14 is prepared. The evaluation results are shown in Table 1.

Example 15

The procedure in Example 1 is repeated except for replacing the phthalimide isoindole derivative No. 8 with another phthalimide isoindole derivative No. 33. Thus, a photoreceptor No. 15 is prepared. The evaluation results are shown in Table 1.

TABLE 1

| | | | Initial stage | | After printing 100,000 sheets | |
|---|---|---|---|---|---|---|
| Ex. | Photo-receptor No. | Phthalimide isoindole derivative No. | Bright section potential (V) | Dot reso-lution | Bright section potential (V) | Dot resolution |
| 1 | 1 | 8 | 105 | 5 | 125 | 5 |
| 2 | 2 | 1 | 100 | 5 | 120 | 5 |
| 3 | 3 | 3 | 105 | 5 | 120 | 5 |
| 4 | 4 | 5 | 105 | 5 | 125 | 5 |
| 5 | 5 | 7 | 95 | 5 | 115 | 5 |
| 6 | 6 | 9 | 105 | 5 | 125 | 5 |
| 7 | 7 | 11 | 100 | 5 | 125 | 5 |
| 8 | 8 | 13 | 115 | 5 | 145 | 4 |
| 9 | 9 | 15 | 110 | 5 | 125 | 4 |
| 10 | 10 | 17 | 110 | 5 | 140 | 5 |
| 11 | 11 | 21 | 100 | 5 | 140 | 4 |
| 12 | 12 | 23 | 110 | 5 | 120 | 5 |
| 13 | 13 | 25 | 100 | 5 | 125 | 3 |
| 14 | 14 | 29 | 105 | 5 | 125 | 5 |
| 15 | 15 | 33 | 100 | 5 | 135 | 5 |

Example 16

The procedure in Example 1 is repeated except for replacing the charge transport layer coating liquid with another charge transport layer coating liquid having the following composition:

| | |
|---|---|
| Polycarbonate resin (Z-form polycarbonate resin from Teijin Chemicals Ltd.) | 10 parts |
| Phthalimide isoindole derivative No. 8 | 1 part |
| Triphenylamine charge transport material CTL-1 | 9 parts |

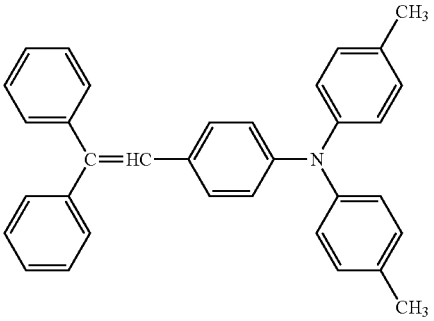

(CTL-1)

| | |
|---|---|
| Tetrahydrofuran | 100 parts |

Thus, a photoreceptor No. 16 is prepared. The photoreceptor No. 16 is evaluated in the same manner as Example 1 except for replacing the positive scorotron corona charging method with a negative scorotron corona charging method. The evaluation results are shown in Table 2.

Example 17

The procedure in Example 16 is repeated except for replacing the phthalimide isoindole derivative No. 8 with another phthalimide isoindole derivative No. 1. Thus, a photoreceptor No. 17 is prepared. The evaluation results are shown in Table 2.

Example 18

The procedure in Example 16 is repeated except for replacing the phthalimide isoindole derivative No. 8 with another phthalimide isoindole derivative No. 3. Thus, a photoreceptor No. 18 is prepared. The evaluation results are shown in Table 2.

Example 19

The procedure in Example 16 is repeated except for replacing the phthalimide isoindole derivative No. 8 with another phthalimide isoindole derivative No. 5. Thus, a photoreceptor No. 19 is prepared. The evaluation results are shown in Table 2.

Example 20

The procedure in Example 16 is repeated except for replacing the phthalimide isoindole derivative No. 8 with another phthalimide isoindole derivative No. 7. Thus, a photoreceptor No. 20 is prepared. The evaluation results are shown in Table 2.

Example 21

The procedure in Example 16 is repeated except for replacing the phthalimide isoindole derivative No. 8 with another phthalimide isoindole derivative No. 9. Thus, a photoreceptor No. 21 is prepared. The evaluation results are shown in Table 2.

Example 22

The procedure in Example 16 is repeated except for replacing the phthalimide isoindole derivative No. 8 with another phthalimide isoindole derivative No. 11. Thus, a photoreceptor No. 22 is prepared. The evaluation results are shown in Table 2.

Example 23

The procedure in Example 16 is repeated except for replacing the phthalimide isoindole derivative No. 8 with another phthalimide isoindole derivative No. 13. Thus, a photoreceptor No. 23 is prepared. The evaluation results are shown in Table 2.

Example 24

The procedure in Example 16 is repeated except for replacing the phthalimide isoindole derivative No. 8 with another phthalimide isoindole derivative No. 15. Thus, a photoreceptor No. 24 is prepared. The evaluation results are shown in Table 2.

Example 25

The procedure in Example 16 is repeated except for replacing the phthalimide isoindole derivative No. 8 with another phthalimide isoindole derivative No. 17. Thus, a photoreceptor No. 25 is prepared. The evaluation results are shown in Table 2.

Example 26

The procedure in Example 16 is repeated except for replacing the phthalimide isoindole derivative No. 8 with another phthalimide isoindole derivative No. 21. Thus, a photoreceptor No. 26 is prepared. The evaluation results are shown in Table 2.

Example 27

The procedure in Example 16 is repeated except for replacing the phthalimide isoindole derivative No. 8 with another phthalimide isoindole derivative No. 23. Thus, a photoreceptor No. 27 is prepared. The evaluation results are shown in Table 2.

Example 28

The procedure in Example 16 is repeated except for replacing the phthalimide isoindole derivative No. 8 with another phthalimide isoindole derivative No. 25. Thus, a photoreceptor No. 28 is prepared. The evaluation results are shown in Table 2.

Example 29

The procedure in Example 16 is repeated except for replacing the phthalimide isoindole derivative No. 8 with another phthalimide isoindole derivative No. 29. Thus, a photoreceptor No. 29 is prepared. The evaluation results are shown in Table 2.

Example 30

The procedure in Example 16 is repeated except for replacing the phthalimide isoindole derivative No. 8 with another phthalimide isoindole derivative No. 33. Thus, a photoreceptor No. 30 is prepared. The evaluation results are shown in Table 2.

TABLE 2

| | | | Initial stage | | After printing 100,000 sheets | |
|---|---|---|---|---|---|---|
| Ex. | Photo-receptor No. | Phthalimide isoindole derivative No. | Bright section potential (V) | Dot reso-lution | Bright section potential (V) | Dot resolution |
| 16 | 16 | 8 | −95 | 5 | −110 | 5 |
| 17 | 17 | 1 | −95 | 5 | −105 | 5 |
| 18 | 18 | 3 | −105 | 5 | −115 | 5 |
| 19 | 19 | 5 | −95 | 5 | −115 | 5 |
| 20 | 20 | 7 | −105 | 5 | −120 | 5 |
| 21 | 21 | 9 | −90 | 5 | −110 | 5 |
| 22 | 22 | 11 | −105 | 5 | −115 | 5 |
| 23 | 23 | 13 | −95 | 5 | −115 | 4 |
| 24 | 24 | 15 | −100 | 5 | −110 | 5 |
| 25 | 25 | 17 | −100 | 5 | −115 | 5 |
| 26 | 26 | 21 | −95 | 5 | −115 | 4 |
| 27 | 27 | 23 | −110 | 5 | −115 | 5 |
| 28 | 28 | 25 | −95 | 5 | −100 | 5 |
| 29 | 29 | 29 | −100 | 5 | −110 | 4 |
| 30 | 30 | 33 | −100 | 5 | −115 | 5 |

Example 31

The procedure in Example 17 is repeated except that the amounts of the phthalimide isoindole derivative No. 1 and the triphenylamine charge transport material CTL-1 are changed to 1 part and 7 parts, respectively. Thus, a photoreceptor No. 31 is prepared. The evaluation results are shown in Table 3.

Example 32

The procedure in Example 31 is repeated except that the phthalimide isoindole derivative No. 1 is replaced with another phthalimide isoindole derivative No. 16. Thus, a photoreceptor No. 32 is prepared. The evaluation results are shown in Table 3.

Example 33

The procedure in Example 31 is repeated except that the phthalimide isoindole derivative No. 1 is replaced with another phthalimide isoindole derivative No. 20. Thus, a photoreceptor No. 33 is prepared. The evaluation results are shown in Table 3.

Example 34

The procedure in Example 31 is repeated except that the phthalimide isoindole derivative No. 1 is replaced with another phthalimide isoindole derivative No. 30. Thus, a photoreceptor No. 34 is prepared. The evaluation results are shown in Table 3.

TABLE 3

| | | | Initial stage | | After printing 100,000 sheets | |
|---|---|---|---|---|---|---|
| Ex. | Photo-receptor No. | Phthalimide isoindole derivative No. | Bright section potential (V) | Dot reso-lution | Bright section potential (V) | Dot resolution |
| 31 | 31 | 1 | −95 | 5 | −115 | 5 |
| 32 | 32 | 16 | −100 | 5 | −115 | 5 |
| 33 | 33 | 20 | −105 | 5 | −120 | 4 |
| 34 | 34 | 30 | −95 | 5 | −115 | 5 |

Example 35

The procedure in Example 31 is repeated except that the triphenylamine charge transport material CTL-1 is replaced with another charge transport material CTL-2 having the following formula.

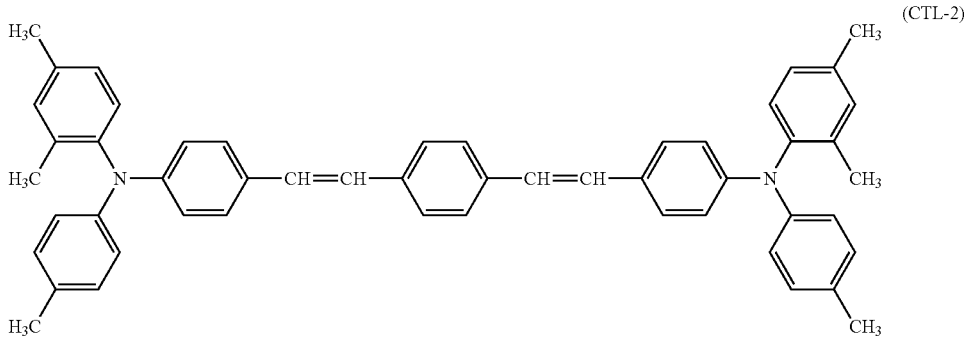

Thus, a photoreceptor No. 35 is prepared. The evaluation results are shown in Table 4.

Example 36

The procedure in Example 32 is repeated except that the triphenylamine charge transport material CTL-1 is replaced with the above charge transport material CTL-2. Thus, a photoreceptor No. 36 is prepared. The evaluation results are shown in Table 4.

Example 37

The procedure in Example 33 is repeated except that the triphenylamine charge transport material CTL-1 is replaced with the above charge transport material CTL-2. Thus, a photoreceptor No. 37 is prepared. The evaluation results are shown in Table 4.

Example 38

The procedure in Example 34 is repeated except that the triphenylamine charge transport material CTL-1 is replaced with the above charge transport material CTL-2. Thus, a photoreceptor No. 38 is prepared. The evaluation results are shown in Table 4.

TABLE 4

| | | | Initial stage | | After printing 100,000 sheets | |
|---|---|---|---|---|---|---|
| Ex. | Photo-receptor No. | Phthalimide isoindole derivative No. | Bright section potential (V) | Dot reso-lution | Bright section potential (V) | Dot resolution |
| 35 | 35 | 1 | −90 | 5 | −100 | 5 |
| 36 | 36 | 16 | −95 | 5 | −110 | 5 |
| 37 | 37 | 20 | −95 | 5 | −105 | 4 |
| 38 | 38 | 30 | −100 | 5 | −115 | 5 |

Example 39

The procedure in Example 31 is repeated except that the triphenylamine charge transport material CTL-1 is replaced with another charge transport material CTL-3 having the following formula:

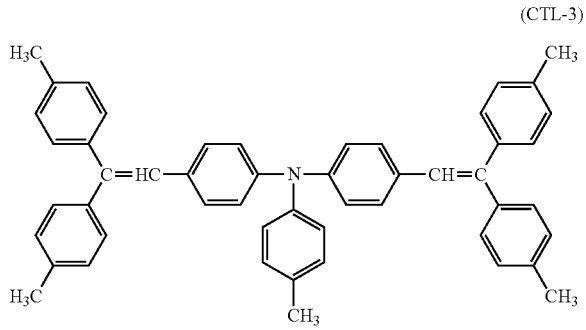

Thus, a photoreceptor No. 39 is prepared. The evaluation results are shown in Table 5.

Example 40

The procedure in Example 32 is repeated except that the triphenylamine charge transport material CTL-1 is replaced with the above charge transport material CTL-3. Thus, a photoreceptor No. 40 is prepared. The evaluation results are shown in Table 5.

Example 41

The procedure in Example 33 is repeated except that the triphenylamine charge transport material CTL-1 is replaced with the above charge transport material CTL-3. Thus, a photoreceptor No. 41 is prepared. The evaluation results are shown in Table 5.

Example 42

The procedure in Example 34 is repeated except that the triphenylamine charge transport material CTL-1 is replaced with the above charge transport material CTL-3. Thus, a photoreceptor No. 42 is prepared. The evaluation results are shown in Table 5.

TABLE 5

| Ex. | Photo-receptor No. | Phthalimide isoindole derivative No. | Initial stage: Bright section potential (V) | Initial stage: Dot reso-lution | After printing 100,000 sheets: Bright section potential (V) | After printing 100,000 sheets: Dot resolution |
|---|---|---|---|---|---|---|
| 39 | 39 | 1 | −105 | 5 | −110 | 5 |
| 40 | 40 | 16 | −95 | 5 | −105 | 5 |
| 41 | 41 | 20 | −105 | 5 | −115 | 4 |
| 42 | 42 | 30 | −100 | 5 | −110 | 5 |

TABLE 6

| Ex. | Photo-receptor No. | Phthalimide isoindole derivative No. | Initial stage: Bright section potential (V) | Initial stage: Dot reso-lution | After printing 100,000 sheets: Bright section potential (V) | After printing 100,000 sheets: Dot resolution |
|---|---|---|---|---|---|---|
| 43 | 43 | 1 | −105 | 5 | −115 | 5 |
| 44 | 44 | 16 | −100 | 5 | −115 | 5 |
| 45 | 45 | 20 | −105 | 5 | −120 | 4 |
| 46 | 46 | 30 | −100 | 5 | −115 | 5 |

Example 43

The procedure in Example 31 is repeated except that the triphenylamine charge transport material CTL-1 is replaced with another charge transport material CTL-4 having the following formula:

(CTL-4)

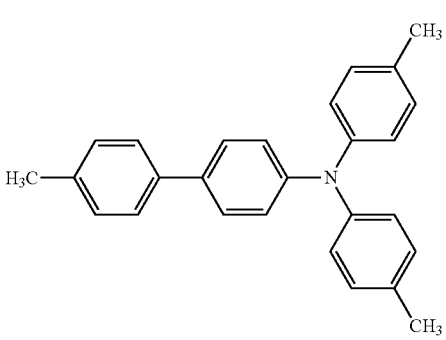

Thus, a photoreceptor No. 43 is prepared. The evaluation results are shown in Table 6.

Example 44

The procedure in Example 32 is repeated except that the triphenylamine charge transport material CTL-1 is replaced with the above charge transport material CTL-4. Thus, a photoreceptor No. 44 is prepared. The evaluation results are shown in Table 6.

Example 45

The procedure in Example 33 is repeated except that the triphenylamine charge transport material CTL-1 is replaced with the above charge transport material CTL-4. Thus, a photoreceptor No. 45 is prepared. The evaluation results are shown in Table 6.

Example 46

The procedure in Example 34 is repeated except that the triphenylamine charge transport material CTL-1 is replaced with the above charge transport material CTL-4. Thus, a photoreceptor No. 46 is prepared. The evaluation results are shown in Table 6.

Example 47

The procedure in Example 20 is repeated except that the charge generation layer coating liquid and the charge transport layer coating liquid are replaced with another charge generation layer coating liquid and another charge transport layer coating liquid, respectively, having the following compositions. Thus, a photoreceptor No. 47 is prepared. The evaluation results are shown in Table 7.

(Preparation of Oxo-Titanium Phthalocyanine)

An oxo-titanium phthalocyanine is prepared according to Synthesis Example 4 in JP-2001-019871-A, the disclosures thereof being incorporated herein by reference. Specifically, 29.2 g of 1,3-diimino isoindoline and 200 ml of sulfolane are mixed, and 20.4 g of titanium tetrabutoxide are further dropped therein under nitrogen gas stream. The resulting mixture is gradually heated to 180° C., and is subjected to a reaction for 5 hours at a reaction temperature of from 170 to 180° C. while being agitated. After the termination of the reaction, the reaction products are left to cool, and then filtered to separate the deposits. The deposits are washed with chloroform until expressing blue color, and then washed with methanol for several times. Further, the deposits are washed with hot water of 80° C. for several times, and dried. Thus, a crude titanyl phthalocyanine is prepared.

Figure 11:
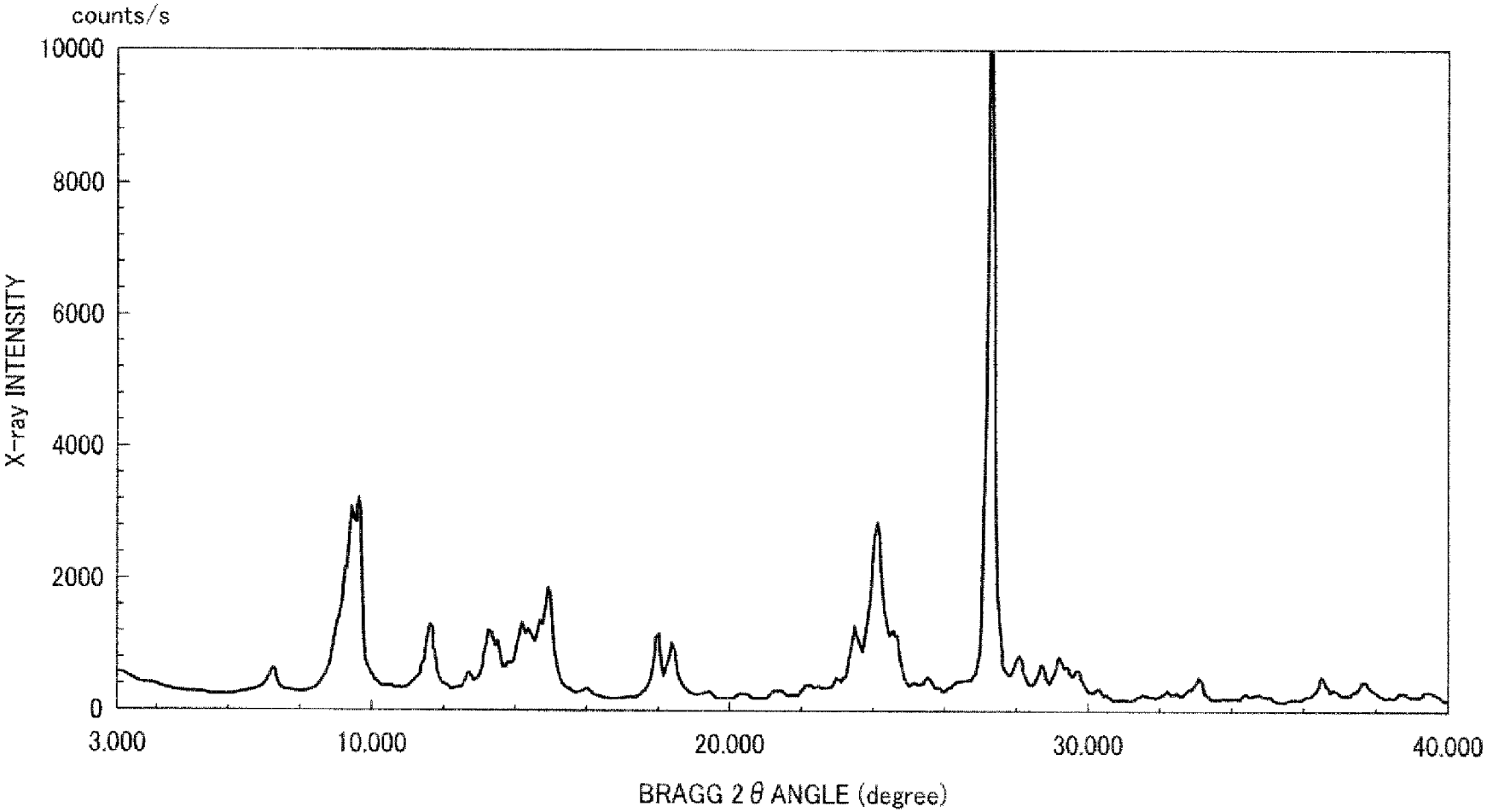
FIG. 11 shows a powder XD spectrum of a titanyl phthalocyanine pigment according to this specification.

The crude titanyl phthalocyanine is dissolved in 20 times its weight of concentrated sulfuric acid, and the resulting solution is dropped in 100 times its weight of ice water while agitating. The mixture is filtered to separate the deposited crystal. The deposited crystal is washed with water until the washing water is neutralized. Thus, a wet cake of a titanyl phthalocyanine pigment is prepared. FIG. 11 shows a powder XD spectrum of the dried cake of the titanyl phthalocyanine pigment.

Next, 2 g of the wet cake of the titanyl phthalocyanine pigment are mixed with 20 g of carbon disulfide for 4 hours. Further, 100 g of methanol are mixed therein for 1 hour. The resulting mixture is filtered and dried, thus preparing powders of an oxo-titanium phthalocyanine crystal.

(Composition of Charge Generation Layer Coating Liquid)

| | |
|---|---|
| Oxo-titanium phthalocyanine prepared above, showing a powder XD spectrum illustrated in FIG. 11 | 8 parts |
| Polyvinyl butyral (BX-1) | 5 parts |
| 2-Butanone | 400 parts |

(Composition of Charge Transport Layer Coating Liquid)

| | |
|---|---|
| Polycarbonate resin (Z-form polycarbonate resin from Teijin Chemicals Ltd.) | 10 parts |
| Phthalimide isoindole derivative No. 7 | 1 part |
| Triphenylamine charge transport material CTL-1 (described in Example 16) | 7 parts |
| Toluene | 70 parts |

Example 48

The procedure in Example 47 is repeated except that the phthalimide isoindole derivative No. 7 is replaced with another phthalimide isoindole derivative No. 30. Thus, a photoreceptor No. 48 is prepared. The evaluation results are shown in Table 7.

TABLE 7

| | | | Initial stage | | After printing 100,000 sheets | |
|---|---|---|---|---|---|---|
| Ex. | Photo-receptor No. | Phthalimide isoindole derivative No. | Bright section potential (V) | Dot reso-lution | Bright section potential (V) | Dot resolution |
| 47 | 47 | 7 | −105 | 5 | −120 | 5 |
| 48 | 48 | 30 | −100 | 5 | −115 | 4 |

Example 49

A photosensitive layer coating liquid having the following composition is applied to an aluminum cylinder having a diameter of 100 mm and dried. Thus, a single-layer photoreceptor No. 49 having a photosensitive layer having a thickness of 30 μm is prepared.

(Composition of Photosensitive Layer Coating Liquid)

| | |
|---|---|
| X-type metal-free phthalocyanine (FASTOGEN BLUE 8120B from DIC Corporation) | 2 parts |
| Charge transport material CTL-2 (described in Example 35) | 30 parts |
| Phthalimide isoindole derivative No. 1 | 20 parts |
| Bisphenol Z polycarbonate (PANLITE TS-2050 from Teijin Chemicals Ltd.) | 50 parts |
| Tetrahydrofuran | 500 parts |

(Evaluation)

The above-prepared photoreceptor No. 49 is mounted on a modified image forming apparatus IMAGIO NEO 752 (manufactured and modified by Ricoh Co., Ltd.) employing a positive scorotron corona charging method for charging the photoreceptor and a laser diode (LD) having a wavelength of 780 nm for image irradiation. The dark section potential is set to +700 (V). A running test in which an image is continuously produced on 100,000 sheets is performed. At the beginning of and after the running test, the produced image quality is evaluated and the bright section potential is measured. Dot resolution is also evaluated in the same manner as Example 1. The evaluation results are shown in Table 8.

Example 50

The procedure in Example 49 is repeated except that the phthalimide isoindole derivative No. 1 is replaced with another phthalimide isoindole derivative No. 16. Thus, a photoreceptor No. 50 is prepared. The evaluation results are shown in Table 8.

Example 51

The procedure in Example 49 is repeated except that the phthalimide isoindole derivative No. 1 is replaced with another phthalimide isoindole derivative No. 20. Thus, a photoreceptor No. 51 is prepared. The evaluation results are shown in Table 8.

Example 52

The procedure in Example 49 is repeated except that the phthalimide isoindole derivative No. 1 is replaced with another phthalimide isoindole derivative No. 30. Thus, a photoreceptor No. 52 is prepared. The evaluation results are shown in Table 8.

TABLE 8

| | | | Initial stage | | After printing 100,000 sheets | |
|---|---|---|---|---|---|---|
| Ex. | Photo-receptor No. | Phthalimide isoindole derivative No. | Bright section potential (V) | Dot reso-lution | Bright section potential (V) | Dot resolution |
| 49 | 49 | 1 | 105 | 5 | 115 | 5 |
| 50 | 50 | 16 | 100 | 5 | 110 | 5 |
| 51 | 51 | 20 | 95 | 5 | 110 | 5 |
| 52 | 52 | 30 | 100 | 5 | 120 | 5 |

Example 53

The photosensitive layer coating liquid prepared in Example 49 is applied to an aluminum cylinder having a diameter of 30 mm and dried. Thus, a single-layer photoreceptor No. 53 having a photosensitive layer having a thickness of 30 μm is prepared. The photoreceptor No. 53 is evaluated in the same manner as Example 16. The evaluation results are shown in Table 9.

Example 54

The photosensitive layer coating liquid prepared in Example 50 is applied to an aluminum cylinder having a diameter of 30 mm and dried. Thus, a single-layer photoreceptor No. 54 having a photosensitive layer having a thickness of 30 μm is prepared. The photoreceptor No. 54 is evaluated in the same manner as Example 16. The evaluation results are shown in Table 9.

Example 55

The photosensitive layer coating liquid prepared in Example 51 is applied to an aluminum cylinder having a diameter of 30 mm and dried. Thus, a single-layer photoreceptor No. 55 having a photosensitive layer having a thickness of 30 μm is prepared. The photoreceptor No. 55 is evaluated in the same manner as Example 16. The evaluation results are shown in Table 9.

Example 56

The photosensitive layer coating liquid prepared in Example 52 is applied to an aluminum cylinder having a diameter of 30 mm and dried. Thus, a single-layer photoreceptor No. 56 having a photosensitive layer having a thickness of 30 μm is prepared. The photoreceptor No. 56 is evaluated in the same manner as Example 16. The evaluation results are shown in Table 9.

TABLE 9

| | | | Initial stage | | After printing 100,000 sheets | |
|---|---|---|---|---|---|---|
| Ex. | Photo-receptor No. | Phthalimide isoindole derivative No. | Bright section potential (V) | Dot reso-lution | Bright section potential (V) | Dot resolution |
| 53 | 53 | 1 | −100 | 5 | −120 | 5 |
| 54 | 54 | 16 | −100 | 5 | −125 | 4 |
| 55 | 55 | 20 | −105 | 5 | −115 | 4 |
| 56 | 56 | 30 | −110 | 5 | −130 | 4 |

Example 57

A charge transport layer coating liquid and a charge generation layer coating liquid, each having the following compositions, are successively applied to an aluminum cylinder having a diameter of 100 mm and dried, in this order. Thus, a photoreceptor No. 57 having a charge transport layer having a thickness of 20 μm and a charge generation layer having a thickness of 0.1 μm is prepared. The photoreceptor No. 57 is evaluated in the same manner as Example 53. The evaluation results are shown in Table 10.

(Composition of Charge Transport Layer Coating Liquid)

| | |
|---|---|
| Bisphenol A polycarbonate (PANLITE C-1400 from Teijin Chemicals Ltd.) | 10 parts |
| Toluene | 100 parts |
| Phthalimide isoindole derivative No. 1 | 10 parts |

(Composition of Charge Generation Layer Coating Liquid)

| | |
|---|---|
| Polyvinyl butyral (XYHL from UCC) | 0.5 parts |
| Cyclohexanone | 200 parts |
| Methyl ethyl ketone | 80 parts |
| X-type metal-free phthalocyanine (FASTOGEN BLUE 8120B from DIC Corporation) | 2 parts |

Example 58

The procedure in Example 57 is repeated except that the phthalimide isoindole derivative No. 1 is replaced with another phthalimide isoindole derivative No. 16. Thus, a photoreceptor No. 58 is prepared. The evaluation results are shown in Table 10.

Example 59

The procedure in Example 57 is repeated except that the phthalimide isoindole derivative No. 1 is replaced with another phthalimide isoindole derivative No. 20. Thus, a photoreceptor No. 59 is prepared. The evaluation results are shown in Table 10.

Example 60

The procedure in Example 57 is repeated except that the phthalimide isoindole derivative No. 1 is replaced with another phthalimide isoindole derivative No. 30. Thus, a photoreceptor No. 60 is prepared. The evaluation results are shown in Table 10.

TABLE 10

| | | | Initial stage | | After printing 100,000 sheets | |
|---|---|---|---|---|---|---|
| Ex. | Photo-receptor No. | Phthalimide isoindole derivative No. | Bright section potential (V) | Dot reso-lution | Bright section potential (V) | Dot resolution |
| 57 | 57 | 1 | −105 | 5 | −110 | 5 |
| 58 | 58 | 16 | −95 | 5 | −110 | 5 |
| 59 | 59 | 20 | −105 | 5 | −120 | 5 |
| 60 | 60 | 30 | −105 | 5 | −115 | 5 |

Example 61

The evaluation procedure for the photoreceptor No. 1 (including the phthalimide isoindole derivative No. 8) in Example 1 is repeated except for replacing the positive scorotron corona charging method with a negative scorotron corona charging method. The evaluation results are shown in Table 11.

Example 62

The evaluation procedure for the photoreceptor No. 2 (including the phthalimide isoindole derivative No. 1) in Example 2 is repeated except for replacing the positive scorotron corona charging method with a negative scorotron corona charging method. The evaluation results are shown in Table 11.

Example 63

The evaluation procedure for the photoreceptor No. 3 (including the phthalimide isoindole derivative No. 3) in Example 3 is repeated except for replacing the positive scorotron corona charging method with a negative scorotron corona charging method. The evaluation results are shown in Table 11.

Example 64

The evaluation procedure for the photoreceptor No. 4 (including the phthalimide isoindole derivative No. 5) in Example 4 is repeated except for replacing the positive scorotron corona charging method with a negative scorotron corona charging method. The evaluation results are shown in Table 11.

Example 65

The evaluation procedure for the photoreceptor No. 5 (including the phthalimide isoindole derivative No. 7) in Example 5 is repeated except for replacing the positive scorotron corona charging method with a negative scorotron corona charging method. The evaluation results are shown in Table 11.

Example 66

The evaluation procedure for the photoreceptor No. 6 (including the phthalimide isoindole derivative No. 9) in Example 6 is repeated except for replacing the positive scorotron corona charging method with a negative scorotron corona charging method. The evaluation results are shown in Table 11.

Example 67

The evaluation procedure for the photoreceptor No. 7 (including the phthalimide isoindole derivative No. 11) in Example 7 is repeated except for replacing the positive scorotron corona charging method with a negative scorotron corona charging method. The evaluation results are shown in Table 11.

Example 68

The evaluation procedure for the photoreceptor No. 8 (including the phthalimide isoindole derivative No. 13) in Example 8 is repeated except for replacing the positive scorotron corona charging method with a negative scorotron corona charging method. The evaluation results are shown in Table 11.

Example 69

The evaluation procedure for the photoreceptor No. 9 (including the phthalimide isoindole derivative No. 15) in Example 9 is repeated except for replacing the positive scorotron corona charging method with a negative scorotron corona charging method. The evaluation results are shown in Table 11.

Example 70

The evaluation procedure for the photoreceptor No. 10 (including the phthalimide isoindole derivative No. 17) in Example 10 is repeated except for replacing the positive scorotron corona charging method with a negative scorotron corona charging method. The evaluation results are shown in Table 11.

Example 71

The evaluation procedure for the photoreceptor No. 11 (including the phthalimide isoindole derivative No. 21) in Example 11 is repeated except for replacing the positive scorotron corona charging method with a negative scorotron corona charging method. The evaluation results are shown in Table 11.

Example 72

The evaluation procedure for the photoreceptor No. 12 (including the phthalimide isoindole derivative No. 23) in Example 12 is repeated except for replacing the positive scorotron corona charging method with a negative scorotron corona charging method. The evaluation results are shown in Table 11.

Example 73

The evaluation procedure for the photoreceptor No. 13 (including the phthalimide isoindole derivative No. 25) in Example 13 is repeated except for replacing the positive scorotron corona charging method with a negative scorotron corona charging method. The evaluation results are shown in Table 11.

Example 74

The evaluation procedure for the photoreceptor No. 14 (including the phthalimide isoindole derivative No. 29) in Example 14 is repeated except for replacing the positive scorotron corona charging method with a negative scorotron corona charging method. The evaluation results are shown in Table 11.

Example 75

The evaluation procedure for the photoreceptor No. 15 (including the phthalimide isoindole derivative No. 33) in Example 15 is repeated except for replacing the positive scorotron corona charging method with a negative scorotron corona charging method. The evaluation results are shown in Table 11.

TABLE 11

| | | | Initial stage | | After printing 100,000 sheets | |
|---|---|---|---|---|---|---|
| Ex. | Photo-receptor No. | Phthalimide isoindole derivative No. | Bright section potential (V) | Dot reso-lution | Bright section potential (V) | Dot resolution |
| 61 | 1 | 8 | −95 | 5 | −120 | 5 |
| 62 | 2 | 1 | −90 | 5 | −115 | 5 |
| 63 | 3 | 3 | −100 | 5 | −105 | 5 |
| 64 | 4 | 5 | −95 | 5 | −115 | 5 |
| 65 | 5 | 7 | −95 | 5 | −105 | 5 |
| 66 | 6 | 9 | −100 | 5 | −115 | 5 |
| 67 | 7 | 11 | −105 | 5 | −120 | 5 |
| 68 | 8 | 13 | −105 | 5 | −135 | 4 |
| 69 | 9 | 15 | −100 | 5 | −115 | 4 |
| 70 | 10 | 17 | −105 | 5 | −120 | 5 |
| 71 | 11 | 21 | −105 | 5 | −135 | 4 |
| 72 | 12 | 23 | −115 | 4 | −125 | 4 |
| 73 | 13 | 25 | −95 | 5 | −120 | 4 |
| 74 | 14 | 29 | −105 | 5 | −115 | 5 |
| 75 | 15 | 33 | −100 | 5 | −135 | 4 |

Example 76

The procedure in Example 16 is repeated except that the charge transport layer coating liquid is replaced with another charge transport layer coating liquid having the following composition:

| | |
|---|---|
| Polycarbonate resin (Z-form polycarbonate resin from Teijin Chemicals Ltd.) | 10 parts |
| Phthalimide isoindole derivative No. 8 | 1 part |

-continued

| | |
|---|---|
| Diphenoquinone charge transport material having the following formula | 9 parts |
| 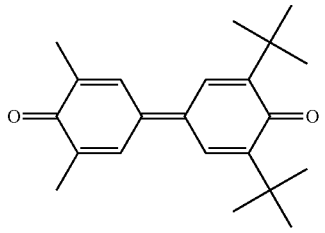 | |
| Tetrahydrofuran | 100 parts |

Thus, a photoreceptor No. 61 is prepared. The photoreceptor No. 61 is evaluated in the same manner as Example 16 except for replacing the negative scorotron corona charging method with a positive scorotron corona charging method. The evaluation results are shown in Table 12.

Example 77

The procedure in Example 76 is repeated except that the diphenoquinone charge transport material is replaced with a naphthoquinone charge transport material having the following formula:

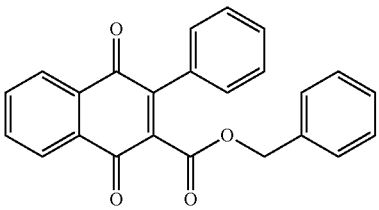

Thus, a photoreceptor No. 62 is prepared. The evaluation results are shown in Table 12.

Example 78

The procedure in Example 76 is repeated except that the diphenoquinone charge transport material is replaced with a naphthalenetetracarboxylic acid charge transport material having the following formula:

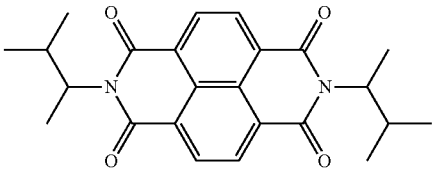

Thus, a photoreceptor No. 63 is prepared. The evaluation results are shown in Table 12.

Example 79

The procedure in Example 76 is repeated except that the diphenoquinone charge transport material is replaced with a naphthalenetetracarboxylic acid dimer charge transport material having the following formula:

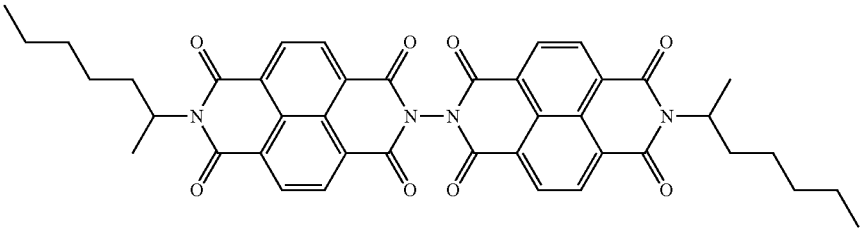

Thus, a photoreceptor No. 64 is prepared. The evaluation results are shown in Table 12.

TABLE 12

| | | | Initial stage | | After printing 100,000 sheets | |
|---|---|---|---|---|---|---|
| Ex. | Photo-receptor No. | Phthalimide isoindole derivative No. | Bright section potential (V) | Dot reso-lution | Bright section potential (V) | Dot resolution |
| 76 | 61 | 8 | 105 | 5 | 115 | 5 |
| 77 | 62 | 8 | 95 | 5 | 115 | 5 |
| 78 | 63 | 8 | 90 | 5 | 105 | 5 |
| 79 | 64 | 8 | 95 | 5 | 100 | 5 |

Comparative Example 1

The procedure in Example 1 is repeated except for replacing the phthalimide isoindole derivative No. 8 with a benzoquinone derivative having the following formula:

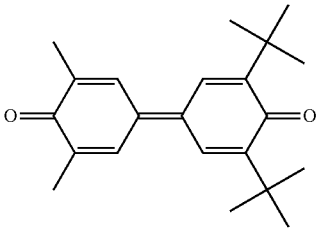

Thus, a comparative photoreceptor No. 1 is prepared. The evaluation results are shown in Table 13.

Comparative Example 2

The procedure in Example 16 is repeated except for changing the amounts of the phthalimide isoindole derivative and the charge transport material to 0 part and 10 parts, respectively. Thus, a comparative photoreceptor No. 2 is prepared. The evaluation results are shown in Table 13.

Comparative Example 3

The procedure in Example 35 is repeated except for replacing the phthalimide isoindole derivative with a tetraphenylmethane compound (disclosed in JP-2000-231204-A, the disclosures thereof being incorporated herein by reference) having the following formula:

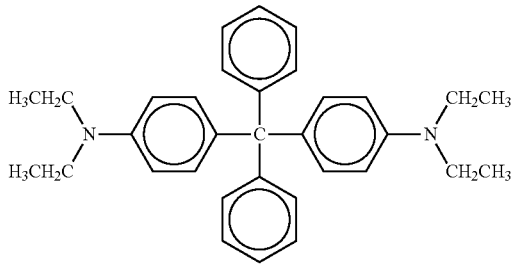

Thus, a comparative photoreceptor No. 3 is prepared. The evaluation results are shown in Table 13.

Comparative Example 4

The procedure in Example 47 is repeated except for replacing the phthalimide isoindole derivative with a hindered amine antioxidant having the following formula:

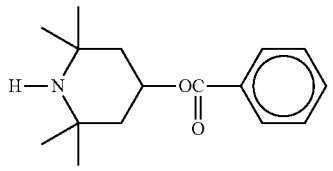

Thus, a comparative photoreceptor No. 4 is prepared. The evaluation results are shown in Table 13.

Comparative Example 5

The procedure in Example 49 is repeated except for replacing 20 parts of the phthalimide isoindole derivative No. 1 with 18 parts of a charge transport material having the following formula:

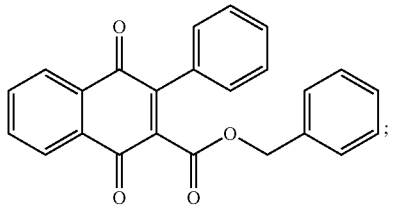

and 2 parts of a charge transport material having the following formula:

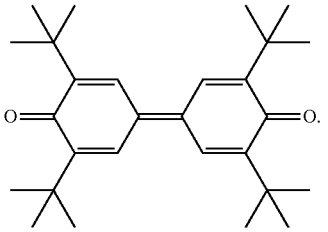

Thus, a comparative photoreceptor No. 5 is prepared. The evaluation results are shown in Table 13.

Comparative Example 6

The procedure in Example 49 is repeated except for replacing 20 parts of the phthalimide isoindole derivative No. 1 with 20 parts of a charge transport material having the following formula:

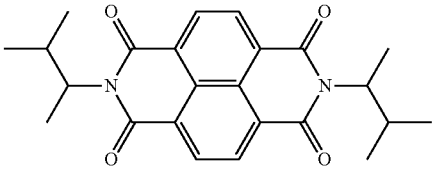

Thus, a comparative photoreceptor No. 6 is prepared. The evaluation results are shown in Table 13.

Comparative Example 7

The procedure in Example 57 is repeated except for replacing 10 parts of the phthalimide isoindole derivative No. 1 with 9 parts of a charge transport material having the following formula:

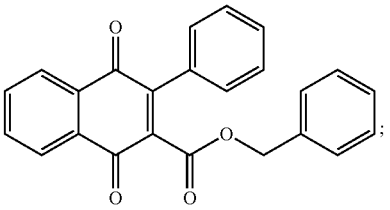

and 1 part of a charge transport material having the following formula:

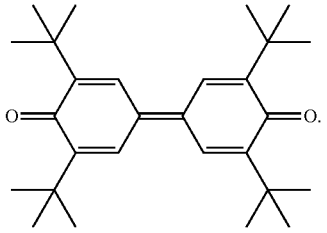

Thus, a comparative photoreceptor No. 7 is prepared. The evaluation results are shown in Table 13.

TABLE 13

| | | Initial stage | | After printing 100,000 sheets | |
|---|---|---|---|---|---|
| Ex. | Photo-receptor No. | Bright section potential (V) | Dot resolution | Bright section potential (V) | Dot resolution |
| Comp. 1 | Comp. 1 | +250 | 3 | +440 | 1 |
| Comp. 2 | Comp. 2 | −100 | 5 | −135 | 2 |
| Comp. 3 | Comp. 3 | −200 | 4 | −285 | 3 |
| Comp. 4 | Comp. 4 | −250 | 2 | −480 | 1 |
| Comp. 5 | Comp. 5 | +105 | 5 | +145 | 1 |
| Comp. 6 | Comp. 6 | +110 | 4 | +155 | 1 |
| Comp. 7 | Comp. 7 | −100 | 4 | −120 | 1 |

The above results show that photoreceptors including the phthalimide isoindole derivative having the formula (1) reliably produce high-quality images without increase of the bright section potential even after producing 100,000 sheets of image. By contrast, the comparative photoreceptors 1, 3, and 4 cause deterioration of image density and resolution because the bright section potential is kept high from the initial stage. Additionally, after printing 100,000 sheets of image, it is impossible to determine image resolution because gradation has considerably decreased.

Tables 1 and 9 show that the photoreceptors including the phthalimide isoindole derivative having the formula (1) produce high-quality images when being charged positively, even after printing 100,000 sheets of image. The comparative photoreceptors 2, 5, 6, and 7 cause deterioration of resolution after printing 100,000 sheets of image although the bright section potential is relatively small.

Examples 80 to 86 and Comparative Example 8

The photoreceptors Nos. 1, 17, 33, 37, 48, 49, and 59 and the comparative photoreceptor No. 2 described in Table 14 are left in a desiccator filled with 50 ppm of nitrogen oxide (NOx) gases for 4 days. Images produced before and after the photoreceptors have been left in the desiccator are evaluated. The evaluation results are shown in Table 14.

In Table 14, "Image Quality (Dot Resolution)" is evaluated as follows.

Before and after being left in the desiccator, a dot image having a pixel density of 600 dpi×600 dpi and an image density of 30% is continuously produced on 10 sheets. The produced image is observed with a stereoscopic microscope to determine whether the dots are blurred or not, and the sharpness of the dot outline (i.e., dot resolution) is graded into the following five levels.

5: Dot outline is clear. Very good.
4: Dot outline is blurred only slightly. Good.
3: Dot outline is blurred slightly. Average.
2: Dot outline is blurred. Poor.
1: Difficult to determine dot outline. Very poor.

TABLE 14

| | | Image Quality (Dot Resolution) | |
|---|---|---|---|
| Example | Photoreceptor No. | Before | After |
| 80 | 1 | 5 | 5 |
| 81 | 17 | 5 | 5 |
| 82 | 33 | 5 | 5 |
| 83 | 37 | 5 | 4 |
| 84 | 48 | 5 | 5 |
| 85 | 49 | 5 | 4 |
| 86 | 59 | 5 | 5 |
| Comparative 8 | Comparative 2 | 5 | 1 |

Table 14 shows that the photoreceptors including the phthalimide isoindole derivative having the formula (1) produce high-resolution image even after exposure to oxidizing gases, i.e., the photoreceptors have good resistance to oxidizing gases. By contrast, the comparative photoreceptor 2 produce low-resolution image after exposure to oxidizing gases.

Additional modifications and variations of the present invention are possible in light of the above teachings. It is therefore to be understood that within the scope of the appended claims the invention may be practiced other than as specifically described herein.

What is claimed is:

1. An electrophotographic photoreceptor, comprising:

a conductive substrate; and a photosensitive layer overlying the conductive substrate, and comprising a phthalimide isoindole derivative having the following formula (1):

(1)

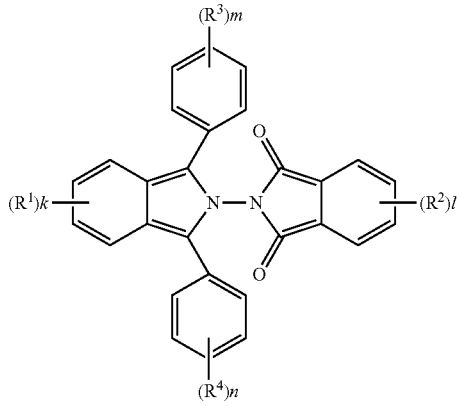

wherein each of $R^1$, $R^2$, $R^3$, and $R^4$ independently represents a hydrogen atom, a substituted or unsubstituted alkyl group, a substituted or unsubstituted aromatic hydrocarbon group, a halogen atom, or a nitro group; each of k and l independently represents an integer of from 1 to 4; and each of m and n independently represents an integer of from 1 to 5.

2. The electrophotographic photoreceptor according to claim 1, wherein the electrophotographic photoreceptor is chargeable to both positive and negative polarities.

3. The electrophotographic photoreceptor according to claim 1, wherein the photosensitive layer further comprises a charge transport material.

4. The electrophotographic photoreceptor according to claim 3, wherein the charge transport material is a derivative having the following formula (2):

(2)

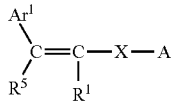

wherein X represents a single bond or a vinylene group; $R^1$ represents a hydrogen atom, a substituted or unsubstituted alkyl group, or a substituted or unsubstituted aromatic hydrocarbon group; $Ar^1$ represents a substituted or unsubstituted aromatic hydrocarbon group; $R^5$ represents a hydrogen atom, a substituted or unsubstituted alkyl group, or a substituted or unsubstituted aromatic hydrocarbon group; $Ar^1$ and $R^5$ may share ring connectivity to form a ring; A represents a substituted or unsubstituted phenyl group having the following formula (3), a substituted or unsubstituted naphthyl group having the following formula (4), 9-anthryl group, or a substituted or unsubstituted carbazolyl group:

(3)

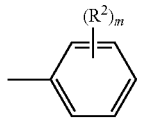

(4)

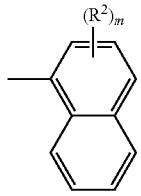

wherein $R^2$ represents a hydrogen atom, an alkyl group, an alkoxy group, a halogen atom, or a group having the following formula (5):

(5)

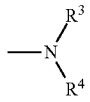

wherein each of $R^3$ and $R^4$ independently represents a substituted or unsubstituted alkyl group or a substituted or unsubstituted aromatic hydrocarbon group; $R^3$ and $R^4$ may share ring connectivity to form a ring; m represents an integer of from 1 to 3; and when m is 2 or more, multiple $R^2$ may be, but need not necessarily be, the same.

5. The electrophotographic photoreceptor according to claim 3, wherein the charge transport material is a triarylamine derivative having the following formula (6):

(6)

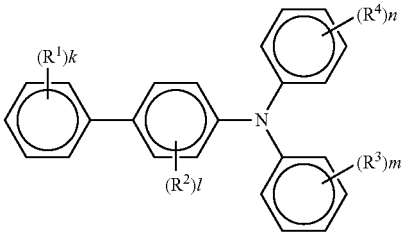

wherein each of $R^1$, $R^3$, and $R^4$ independently represents a hydrogen atom, an amino group, an alkoxy group, a thioalkoxy group, an aryloxy group, a methylenedioxy group, a substituted or unsubstituted alkyl group, a halogen atom, or a substituted or unsubstituted aromatic hydrocarbon group; $R^2$ represents a hydrogen atom, an alkoxy group, a substituted or unsubstituted alkyl group, or a halogen atom; each of k, l, m, and n independently represents an integer of from 1 to 4; and when each of k, l, m, and n is 2 or more, multiple $R^1$, $R^2$, $R^3$, and $R^4$ may be, but need not necessarily be, the same.

6. The electrophotographic photoreceptor according to claim 3, wherein the charge transport material is an arylamine derivative having the following formula (7):

(7)

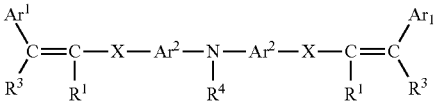

wherein X represents a single bond or a vinylene group; $R^1$ represents a hydrogen atom, a substituted or unsubstituted alkyl group, or a substituted or unsubstituted aromatic hydrocarbon group; $Ar^1$ represents a substituted or unsubstituted aromatic hydrocarbon group; $R^3$ represents a hydrogen atom, a substituted or unsubstituted alkyl group, or a substituted or unsubstituted aromatic hydrocarbon group; $Ar^1$ and $R^3$ may share ring connectivity to form a ring; $Ar^2$ represents a substituted or unsubstituted phenylene group having the following formula (8) or a substituted or unsubstituted naphthylene group having the following formula (9):

(8)

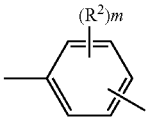

(9)

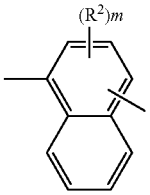

wherein $R^2$ represents a hydrogen atom, an alkyl group, an alkoxy group, or a halogen atom; m represents an integer of from 1 to 3; when m is 2 or more, multiple $R^2$ may be, but need not necessarily be, the same; and $R^4$ represents a substituted or unsubstituted alkyl group or a substituted or unsubstituted aromatic hydrocarbon group.

7. The electrophotographic photoreceptor according to claim 3, wherein the charge transport material is a vinyl-group-containing aromatic hydrocarbon derivative having the following formula (10):

(10)

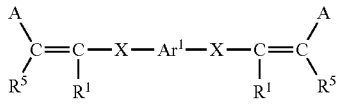

wherein X represents a single bond or a vinylene group; $R^1$ represents a hydrogen atom, a substituted or unsubstituted alkyl group, or a substituted or unsubstituted aromatic hydrocarbon group; $Ar^1$ represents a substituted or unsubstituted divalent aromatic hydrocarbon group; $R^5$ represents a hydrogen atom, a substituted or unsubstituted alkyl group, or a substituted or unsubstituted aromatic hydrocarbon group; A represents a substituted or unsubstituted phenyl group having the following formula (3), a substituted or unsubstituted naphthyl group having the following formula (4), 9-anthryl group, or a substituted or unsubstituted carbazolyl group:

(3)

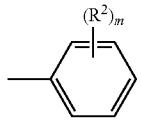

(4)

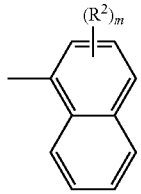

wherein $R^2$ represents a hydrogen atom, an alkyl group, an alkoxy group, a halogen atom, or a group having the following formula (5):

(5)

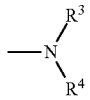

wherein each of $R^3$ and $R^4$ independently represents a substituted or unsubstituted alkyl group or a substituted or unsubstituted aromatic hydrocarbon group; $R^3$ and $R^4$ may share ring connectivity to form a ring; m represents an integer of from 1 to 3; and when m is 2 or more, multiple $R^2$ may be, but need not necessarily be, the same.

8. The electrophotographic photoreceptor according to claim 3, wherein the charge transport material is a diphenoquinone derivative having the following formula (14):

(14)

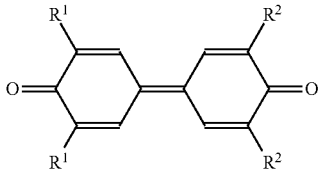

wherein each of $R^1$ and $R^2$ independently represents a hydrogen atom, a substituted or unsubstituted alkyl group, or a substituted or unsubstituted aromatic hydrocarbon group.

9. The electrophotographic photoreceptor according to claim 3, wherein the charge transport material is a naphthoquinone derivative having the following formula (15):

(15)

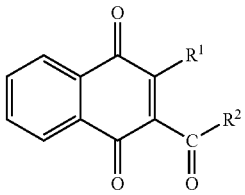

wherein $R^1$ represents a substituted or unsubstituted alkyl group or a substituted or unsubstituted aryl group; $R^2$ represents a substituted or unsubstituted alkyl group, a substituted or unsubstituted aromatic hydrocarbon group, or a group having the following formula (16):

$$—O—R^3 \quad (16)$$

wherein $R^3$ represents a substituted or unsubstituted alkyl group or a substituted or unsubstituted aryl group.

10. The electrophotographic photoreceptor according to claim 3, wherein the charge transport material is a naphthalenetetracarboxylic acid derivative having the following formula (17):

(17)

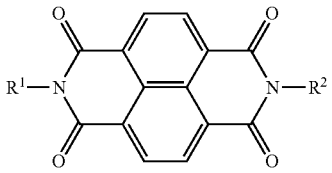

wherein each of $R^1$ and $R^2$ independently represents a hydrogen atom, a substituted or unsubstituted alkyl group, or a substituted or unsubstituted aromatic hydrocarbon group.

11. The electrophotographic photoreceptor according to claim 3, wherein the charge transport material is a naphthalenetetracarboxylic acid dimer derivative having the following formula (18):

(18)

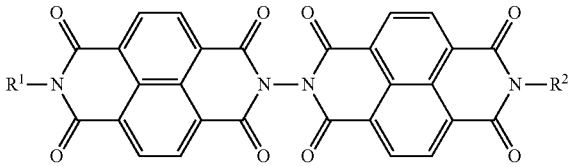

wherein each of $R^1$ and $R^2$ independently represents a hydrogen atom, a substituted or unsubstituted alkyl group, or a substituted or unsubstituted aromatic hydrocarbon group.

12. The electrophotographic photoreceptor according to claim 1, wherein the photosensitive layer has a multilayer structure comprising:

a charge generation layer; and a charge transport layer overlying the charge generation layer.

13. The electrophotographic photoreceptor according to claim 1, wherein the photosensitive layer has a multilayer structure comprising:

a charge transport layer; and a charge generation layer overlying the charge transport layer.

14. The electrophotographic photoreceptor according to claim 1, wherein the photosensitive layer is a single layer.

15. An electrophotographic image forming method, comprising:

charging the electrophotographic photoreceptor according to claim 1;

irradiating the charged photoreceptor with light containing image information to form an electrostatic latent image thereon;

developing the electrostatic latent image with a toner to form a toner image; and transferring the toner image from the photoreceptor onto a transfer material.

16. The electrophotographic image forming method according to claim 15, wherein the light containing image information is emitted from a laser diode or a light-emitting diode.

17. An electrophotographic image forming apparatus, comprising:

the electrophotographic photoreceptor according to claim 1 that bears an electrostatic latent image;

a charger that charges the photoreceptor;

an irradiator that irradiates the charged photoreceptor with light containing image information to form an electrostatic latent image thereon;

a developing device that develops the electrostatic latent image with a toner to form a toner image; and a transfer device that transfers the toner image from the photoreceptor onto a transfer material.

18. The electrophotographic image forming apparatus according to claim 17, wherein the irradiator is a laser diode or a light-emitting diode.

19. An electrophotographic process cartridge detachably mountable on image forming apparatus, comprising:

the electrophotographic photoreceptor according to claim 1 that bears an electrostatic latent image; and at least one of a charger that charges the photoreceptor, a developing device that develops the electrostatic latent image into a toner image, and a cleaning device that removes residual toner particles remaining on the photoreceptor after transferring a toner image therefrom.

* * * * *